US010595133B2

(12) United States Patent
Straeussnigg et al.

(10) Patent No.: US 10,595,133 B2
(45) Date of Patent: Mar. 17, 2020

(54) MICROPHONE MODULE

(71) Applicant: Infineon Technologies AG, Neubiberg (DE)

(72) Inventors: Dietmar Straeussnigg, Villach (AT); Elmar Bach, Villach (AT); Niccolo De Milleri, Villach (AT); Luca Sant, Tarcento (IT); Andreas Wiesbauer, Poertschach (AT)

(73) Assignee: INFINEON TECHNOLOGIES AG, Neubiberg (DE)

( * ) Notice: Subject to any disclaimer, the term of this patent is extended or adjusted under 35 U.S.C. 154(b) by 0 days.

(21) Appl. No.: 16/293,081

(22) Filed: Mar. 5, 2019

(65) Prior Publication Data

US 2019/0289404 A1 Sep. 19, 2019

(30) Foreign Application Priority Data

Mar. 16, 2018 (DE) ..... 10 2018 204 052
Jan. 17, 2019 (DE) ..... 10 2019 200 584

(51) Int. Cl.
*H04R 19/04* (2006.01)
*H04R 19/00* (2006.01)
*H04R 3/00* (2006.01)

(52) U.S. Cl.
CPC ..... *H04R 19/04* (2013.01); *H04R 3/00* (2013.01); *H04R 19/005* (2013.01); *H04R 2201/003* (2013.01)

(58) Field of Classification Search
CPC ..... H04R 19/04; H04R 3/00; H04R 19/005; H04R 2201/0003
See application file for complete search history.

(56) References Cited

U.S. PATENT DOCUMENTS

2015/0350760 A1* 12/2015 Nandy ..... G10L 15/00 381/110
2016/0192084 A1 6/2016 Oliaei
2016/0344358 A1 11/2016 Oliaei

* cited by examiner

*Primary Examiner* — Andrew L Sniezek
(74) *Attorney, Agent, or Firm* — Slater Matsil, LLP

(57) ABSTRACT

A microphone module includes a first MEMS microphone and a second MEMS microphone, wherein the first MEMS microphone includes a first modulator, and wherein the second MEMS microphone includes a second modulator. For the purpose of noise reduction, a defined offset can be applied to an input of the first modulator or of the second modulator. Alternatively, for the purpose of noise reduction, the first modulator and the second modulator can be operated with different modulation frequencies.

38 Claims, 17 Drawing Sheets

MICROPHONE MODULE

This application claims the benefit of German Application Nos. 102018204052.4, filed on Mar. 16, 2018 and 102019200584.5 filed Jan. 17, 2019, which applications are hereby incorporated herein by reference.

TECHNICAL FIELD

Exemplary embodiments relate to a microphone module and, specifically, to a microphone module comprising two MEMS (Micro-Electro-Mechanical Systems) microphones. Some exemplary embodiments relate to a stereo microphone module. Some exemplary embodiments relate to a microphone application with stereo noise reduction.

BACKGROUND

When two microphones are used in stereo operation, interference effects (stereo noise) can occur if the two microphones are connected to a DSP via a single line. Charge reversal effects give rise to additional power loss that causes interference (stereo noise) in the audio band by way of the thermo-acoustic effect. The stereo noise causes a deterioration in performance, such as e.g. a reduction of the SNR (SNR=signal-to-noise ratio).

SUMMARY

Exemplary embodiments provide a microphone module comprising a first MEMS microphone, wherein the first MEMS microphone comprises a first modulator, a second MEMS microphone, wherein the second MEMS microphone comprises a second modulator, and an offset generator, wherein the offset generator is connected to an input of the first modulator or the second modulator, wherein the offset generator is configured to apply a defined offset to the input of the first modulator or of the second modulator.

In exemplary embodiments, the offset generator can be configured to adapt the defined offset.

In exemplary embodiments, the offset generator can be configured to adapt the defined offset in such a way that limit cycles of the first modulator and of the second modulator differ by at least 5 kHz (or 7 kHz, or 8 kHz, or 10 kHz, or 15 kHz, or 20 kHz).

In exemplary embodiments, the defined offset can be −60 dBFS or more (or −50 dBFS or more, or −45 dBFS or more, or −40 dBFS or more, or −35 dBFS or more).

In exemplary embodiments, the first modulator and the second modulator can be 1-bit (single bit) modulators.

In exemplary embodiments, outputs of the first modulator and of the second modulator can be connected to the same line or data line.

In exemplary embodiments, the first MEMS microphone and the second MEMS microphone can be clocked with the same clock signal.

In exemplary embodiments, the first modulator and the second modulator can be clocked with different edges of the same clock signal.

In exemplary embodiments, the first modulator and the second modulator can be digital modulators, wherein the defined offset can be a digital word.

In exemplary embodiments, the first modulator and the second modulator can be analog-to-digital converters, wherein the defined offset can be an analog DC value.

In exemplary embodiments, the offset generator can be directly connected to the input of the first modulator or of the second modulator.

In exemplary embodiments, the offset generator can be connected to the respective input of the first modulator or of the second modulator via a block connected upstream of the first modulator or the second modulator.

In exemplary embodiments, the offset generator can be a first offset generator, which can be connected to the input of the first modulator, wherein the microphone module can comprise a second offset generator, which can be connected to the input of the second modulator, wherein the second offset generator can be configured to apply a defined offset to the input of the second modulator.

In exemplary embodiments, the first MEMS microphone and the second MEMS microphone can be switchable in each case between a first operating state and a second operating state, wherein the first offset generator can be configured to apply the defined first offset to the input of the first modulator only if the first MEMS microphone is switched into a first operating state, wherein the second offset generator can be configured to apply the defined offset to the input of the second modulator only if the second MEMS microphone is switched into a second operating state, wherein the first MEMS microphone and the second MEMS microphone are switched into different operating states. In exemplary embodiments, MEMS microphone (102_1) and the second MEMS microphone can be switched into the respective operating state by a control signal present at the respective MEMS microphone or by a control value (select L/R) present at the respective MEMS microphone.

In exemplary embodiments, the first offset generator and the second offset generator can be configured to apply different defined offsets to the respective inputs of the first modulator and of the second modulator.

In exemplary embodiments, the first MEMS microphone and the second MEMS microphone can be switchable in each case between a first operating state and a second operating state, wherein the first MEMS microphone and the second MEMS microphone are switched into different operating states, wherein the defined offset can be applied to the input of the first modulator if the first MEMS microphone is switched into the first operating state, wherein the defined offset can be applied to the input of the second modulator if the second MEMS microphone is switched into the first operating state, wherein the first MEMS microphone and the second MEMS microphone are switched into the respective operating state by a control signal present at the respective MEMS microphone or by a control value (select L/R) present at the respective MEMS microphone.

In exemplary embodiments, the first MEMS microphone and the second MEMS microphone can be allocated to different channels of a multi-channel application by the different operating states.

In exemplary embodiments, the first MEMS microphone and the second MEMS microphone can be switchable in each case between a first operating state and a second operating state, wherein the first MEMS microphone and the second MEMS microphone are switched into different operating states, wherein the offset generator is a first offset generator connected to the input of the first modulator, wherein the first offset generator is configured to apply a defined first offset to the input of the first modulator if the first MEMS microphone is switched into the first operating state, wherein the first offset generator is configured to apply a defined second offset to the input of the first modulator if the first MEMS microphone is switched into the second operating state, wherein the microphone module comprises a second offset generator connected to the input of the second modulator, wherein the second offset generator is configured to apply the defined first offset to the input of the second modulator if the second MEMS microphone is switched into the first operating state, wherein the second offset generator is configured to apply the defined second offset to the input of the second modulator if the second MEMS microphone is switched into the second operating state, wherein the defined first offset and the defined second offset are different, wherein the first MEMS microphone and the second MEMS microphone are switched into the respective operating state by a control signal present at the respective MEMS microphone or by a control value (select L/R) present at the respective MEMS microphone.

In exemplary embodiments, the defined first offset and the defined second offset can be different than zero.

In exemplary embodiments, the first MEMS microphone and the second MEMS microphone can be allocated to different channels of a multi-channel application by the different operating states.

In exemplary embodiments, the first MEMS microphone can comprise a first offset compensator connected to the input of the first modulator, wherein the first offset compensator can be configured to reduce an analog offset generated by the microphone module or by the first MEMS microphone (or a digital part of the first MEMS microphone) itself, wherein the second MEMS microphone can comprise a second offset compensator connected to the input of the second modulator, wherein the second offset compensator can be configured to reduce an analog offset generated by the microphone module or by the second MEMS microphone (or a digital part of the second MEMS microphone) itself.

Further exemplary embodiments provide a method for operating a microphone module comprising a first MEMS microphone and a second MEMS microphone. The method comprises a step of generating a defined offset by an offset generator of the microphone module. Furthermore, the method comprises a step of applying the defined offset to an input of a modulator of the first MEMS microphone or of the second MEMS microphone in order to shift a limit cycle of the modulator of the respective MEMS microphone with respect to a limit cycle of a modulator of the other MEMS microphone.

Further exemplary embodiments provide a microphone module comprising a first MEMS microphone, wherein the first MEMS microphone comprises a first modulator, a second MEMS microphone, wherein the second MEMS microphone can comprise a second modulator, wherein the first modulator is clocked with a first clock frequency, and wherein the second modulator is clocked with a second clock frequency, wherein the first clock frequency and the second clock frequency are different.

In exemplary embodiments, one clock frequency of the two clock frequencies (=first clock frequency and second clock frequency) can be reduced relative to the other clock frequency.

In exemplary embodiments, one clock frequency of the two clock frequencies (=first clock frequency and second clock frequency) can be reduced relative to the other clock frequency in such a way that limit cycles of the first modulator and of the second modulator differ by at least the factor 1.5 (or 1.7, or 2).

In exemplary embodiments, the first MEMS microphone can comprise a first sampling rate converter, which can be connected downstream of the first modulator.

In exemplary embodiments, the second MEMS microphone can comprise a second sampling rate converter, which can be connected downstream of the second modulator.

In exemplary embodiments, the first MEMS microphone and the second MEMS microphone can be switchable in each case between a first operating state and a second operating state, wherein the first clock frequency, with which the first modulator is clocked, is reduced relative to the second clock frequency if the first MEMS microphone is switched into the first operating state; wherein the second clock frequency, with which the second modulator is clocked, can be reduced relative to the first clock frequency if the second MEMS microphone is switched into the first operating state; wherein the first MEMS microphone and the second MEMS microphone are switched into different operating states.

In exemplary embodiments, the first MEMS microphone can be configured to connect the first sampling rate converter downstream of the first modulator only in the first operating state, wherein the second MEMS microphone can be configured to connect the second sampling rate converter downstream of the second modulator only in the first operating state.

In exemplary embodiments, the first MEMS microphone can be configured to connect the first sampling rate converter upstream of the first modulator in the second operating state, wherein the second MEMS microphone can be configured to connect the second sampling rate converter upstream of the second modulator in the second operating state.

In exemplary embodiments, the first modulator and the second modulator can be 1-bit (single bit) modulators.

In exemplary embodiments, the first MEMS microphone and the second MEMS microphone can provide output values with the same sampling rate.

In exemplary embodiments, the first MEMS microphone and the second MEMS microphone can provide the respective output values in response to different edges of a clock signal having the first clock frequency or the second clock frequency.

In exemplary embodiments, outputs of the first MEMS microphone and of the second MEMS microphone can be connected to the same data line.

In exemplary embodiments, the first modulator and the second modulator can be digital modulators.

In exemplary embodiments, the first MEMS microphone can comprise a first digital filter, wherein the first digital filter can be connected upstream of the first modulator (in the first operating state) or the first sampling rate converter (in the second operating state), and wherein the first digital filter can be clocked with the first clock frequency, wherein the second MEMS microphone can comprise a second digital filter, wherein the second digital filter is connected upstream of the second sampling rate converter (in the second operating state) or the second modulator (in the first operating state), and wherein the second digital filter can be clocked with the first clock frequency.

In exemplary embodiments, the first MEMS microphone can comprise a first analog-to-digital converter, wherein the first analog-to-digital converter can be clocked with the first clock frequency, wherein the second MEMS microphone can comprise a second analog-to-digital converter, wherein the second analog-to-digital converter can be clocked with the first clock frequency.

In exemplary embodiments, the first MEMS microphone can comprise a first analog-to-digital converter, wherein the first analog-to-digital converter can be clocked with the second clock frequency, wherein the first MEMS microphone can comprise a third sampling rate converter connected downstream of the first analog-to-digital converter, wherein the second MEMS microphone can comprise a second analog-to-digital converter, wherein the second analog-to-digital converter can be clocked with the second clock frequency, wherein the second MEMS microphone can comprise a fourth sampling rate converter connected downstream of the second analog-to-digital converter.

In exemplary embodiments, the first modulator and the second modulator can be analog-to-digital converters, wherein the first MEMS microphone can comprise a sampling rate converter connected downstream of the first modulator.

Further exemplary embodiments relate to a method for operating a microphone module comprising a first MEMS microphone and a second MEMS microphone. The method comprises a step of clocking a first modulator of the first MEMS microphone having a first clock frequency. Furthermore, the method comprises a step of clocking a second modulator of the second MEMS microphone with a second clock frequency, wherein the first clock frequency and the second clock frequency are different.

BRIEF DESCRIPTION OF THE DRAWINGS

Exemplary embodiments of the present invention will be described in greater detail with reference to the accompanying figures, in which.

DETAILED DESCRIPTION OF ILLUSTRATIVE EMBODIMENTS

In the following description of the exemplary embodiments of the present invention, identical or identically acting elements are provided with the same reference sign in the figures, and so the description thereof is mutually interchangeable.

Figure 1:
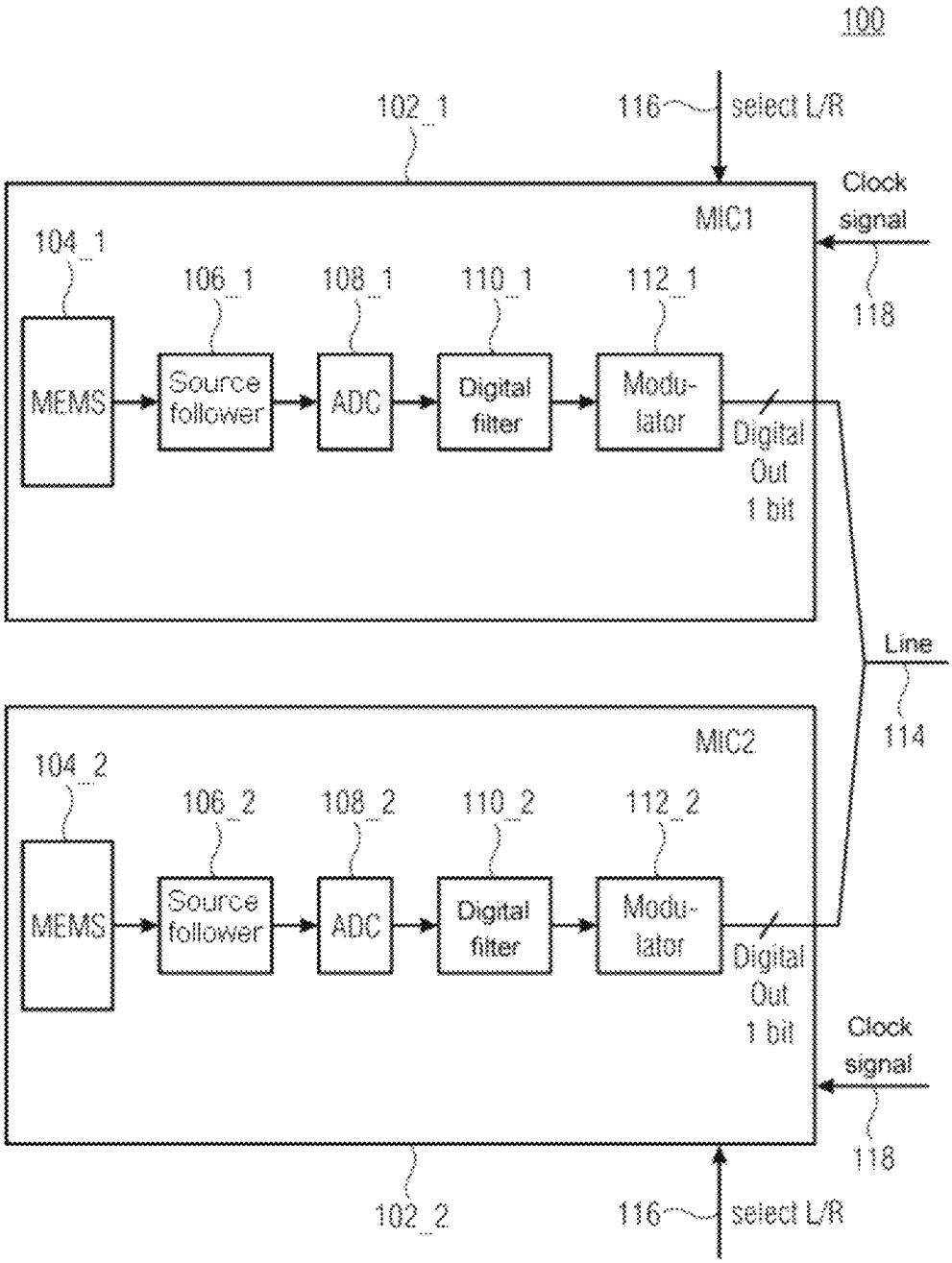
FIG. 1 shows a schematic block diagram of a microphone module comprising a first MEMS microphone and a second MEMS microphone.

When two microphones are used in stereo operation, interference effects (stereo noise) can occur. FIG. 1 illustrates a basic block diagram.

In detail, FIG. 1 shows a schematic block diagram of a microphone module 100 comprising a first MEMS microphone 102_1 and a second MEMS microphone 102_2. In other words, FIG. 1 shows a block diagram of a stereo mode application.

The first MEMS microphone 102_1 comprises a first MEMS microphone unit 104_1, a first amplifier unit 106_1 (e.g. a source follower), a first analog-to-digital converter (ADC) 108_1, a first digital filter 110_1, and a first modulator 112_1. The second MEMS microphone 102_1 comprises a second MEMS microphone unit 104_2, a second amplifier unit 106_2 (e.g. a source follower), a second analog-to-digital converter (ADC) 108_2, a second digital filter 110_2, and a second modulator 112_2.

As can be discerned in FIG. 1, the two microphones can be connected to a DSP via a line 114. With one configuration bit (select L/R) 116 it is possible to stipulate which microphone is sampled with the rising edge and which with the falling edge of the clock signal 118 (clock).

Charge reversal effects give rise to additional power loss that causes interference (stereo noise) in the audio band by way of the thermoacoustic effect. The stereo noise causes a deterioration in performance, such as e.g. a reduction of the SNR (SNR=signal-to-noise ratio).

Figure 2:
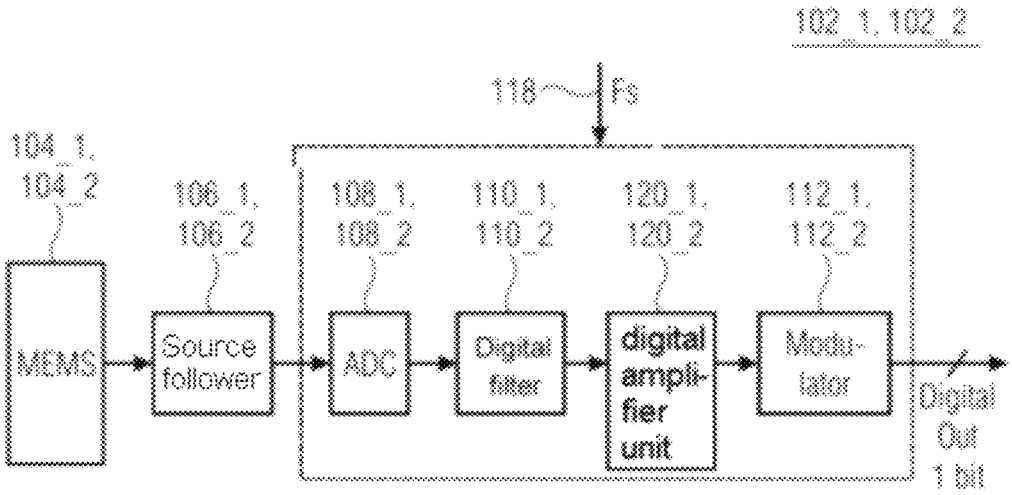
FIG. 2 shows a schematic block diagram of the digital MEMS microphones from FIG. 1, wherein the respective digital part of the MEMS microphones is clocked with a clock frequency of Fs.

FIG. 2 shows a schematic block diagram of the MEMS microphones 102_1 and 102_2 from FIG. 1, wherein the respective digital part of the MEMS microphones 102_1 and 102_2 (i.e. the respective analog-to-digital converter 108_1 and 108_2, the respective digital filter 110_1 and 110_2 and the respective digital modulator 112_1 and 112_2) is clocked with a clock signal 118 having a clock frequency of Fs.

Optionally, the MEMS microphones 102_1 and 102_2 can comprise a respective digital amplifier unit 120_1 and 120_2, which are connected between the respective digital filters 110_1 and 110_2 and the respective digital modulators 112_1 and 112_2, wherein the respective digital amplifier units 120_1 and 120_2 can likewise be clocked with the clock signal 118 having the clock frequency of Fs.

In the text that follows we will describe a first aspect of the claimed subject matter.

The stereo noise is determined principally by the limit cycles of the digital modulators 112_1 and 112_2 in addition to other parameters (e.g. supply voltage). If the frequencies of the limit cycles correspond, then stereo noise arises in the DC range. If the frequencies of the limit cycles are different then depending on the difference in the frequencies of the limit cycles, the stereo noise is shifted toward higher frequencies and weighted with the thermoacoustic frequency response. In general, analog (unknown) offsets occur in the data path, which in turn influence the frequency of the limit cycle of the digital modulator.

Figure 3:
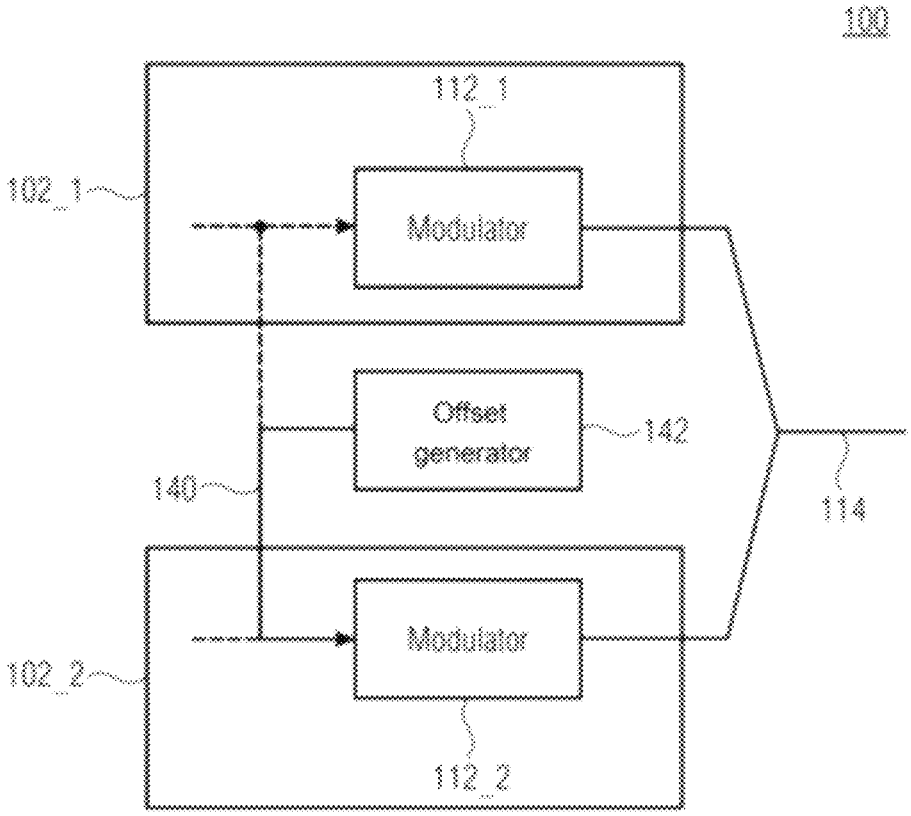
FIG. 3 shows a schematic block diagram of a microphone module comprising a first MEMS microphone, a second MEMS microphone and an offset generator.

By way of example, the microphone module 100 shown in FIG. 3 can be used for reducing the stereo noise.

FIG. 3 shows a schematic block diagram of a microphone module 100 comprising a first MEMS microphone 102_1, a second MEMS microphone 102_2 and an offset generator 142. The first MEMS microphone 102_1 comprises the first modulator 112_1. The second MEMS microphone 102_2 comprises the second modulator 112_2.

As is shown in accordance with one exemplary embodiment in FIG. 3, the offset generator 142 can be connected to an input of the second modulator 112_2, wherein the offset generator 142 can be configured to apply a defined offset 140 to the input of the second modulator 112_2. Alternatively, the offset generator 142 can be connected to an input of the first modulator 112_2, wherein the offset generator 142 can be configured to apply a defined offset 140 to the input of the second modulator 112_2.

In exemplary embodiments, the offset generator 142 can be configured to adapt the defined offset 140. By way of example, the offset generator 142 can be configured to adapt the defined offset 140 in such a way that limit cycles of the first modulator 112_1 and of the second modulator 112_2 differ by 5 kHz (or 7 kHz, or 8 kHz, or 10 kHz, or 15 kHz, or 20 kHz). As a result, the stereo noise can be shifted toward high frequencies and be sufficiently damped by the thermoacoustic frequency response.

In exemplary embodiments, the defined offset 140 can be for example −60 dBFS or more, such as e.g. −50 dBFS or more, −45 dBFS or more, or −40 dBFS or more, or −35 dBFS or more.

In exemplary embodiments, the first modulator 112_1 and the second modulator 112_2 can be 1-bit (single bit) modulators, i.e. modulators which provide only one bit (as sample) at the output per clock cycle of a clock signal 118.

In exemplary embodiments, the offset generator 142 can be directly connected to the input of the first modulator 112_1 or the second modulator 112_2. The offset generator 142 can thus be configured for acting directly on the input of the first modulator 112_1 or the input of the second modulator 112_2.

Of course, in exemplary embodiments it is equally possible for the offset generator 142 to be connected to the input of the first modulator 112_1 or of the second modulator 112_2 not directly but rather via a block connected upstream of the respective modulator 112_1 or 112_2 (e.g. a filter connected upstream of the input of the respective modulator 112_1 or 112_2 (see also FIG. 4)). The offset generator 142 can thus be configured to apply the defined offset 140 to the input of the respective modulator 112_1 or 112_2 via a block connected upstream of the respective modulator 112_1 or 112_2.

As already mentioned, in exemplary embodiments, the defined offset can be applied to the input of the first modulator 112_1 or the input of the second modulator 112_2. In this case, which modulator the defined offset is applied to can be dependent on the respective operating state of the two MEMS microphones 102_1 and 102_2.

In detail, in exemplary embodiments, the first MEMS microphone 102_1 and the second MEMS microphone 102_2 can be switchable (in each case) between a first operating state and a second operating state. In this case, the first MEMS microphone 102_1 and the second MEMS microphone 102_2 should be switched into different operating states, i.e. the first MEMS microphone 102_1 into the first operating state and the second MEMS microphone into the second operating state, or the first MEMS microphone 102_1 into the second operating state and the second MEMS microphone into the first operating state.

In exemplary embodiments, the defined offset 140 can be applied to the input of the first modulator 112_1 if the first MEMS microphone 102_1 is switched into a first operating state (and the second MEMS microphone 102_2 is switched into a second operating state), while the defined offset 140 can be applied to the input of the second modulator 112_2 if the second MEMS microphone 102_2 is switched into the first operating state (and the first MEMS microphone 102_1 is switched into the second operating state).

By way of example, the first MEMS microphone 102_1 and the second MEMS microphone 102_2 can be allocated to different channels of a multi-channel application by the different operating states. For example, in a stereo application, the first operating state can allocate the respective MEMS microphone to a right channel (or left channel), while the second operating state can allocate the respective MEMS microphone to a left channel (or right channel).

In exemplary embodiments, the first MEMS microphone 102_1 and the second MEMS microphone 102_2 can be switched into the respective operating state for example by a control signal 116 present at the respective MEMS microphone or by a control value (select L/R) present at the respective MEMS microphone.

In exemplary embodiments, outputs of the two MEMS microphones 102_1 and 102_2, or in detail outputs of the first modulator 112_1 and of the second modulator 112_2, can be connected to the same line 114 and thus be connected via the same line 114 for example to a downstream signal processing device, such as e.g. a DSP (DSP=digital signal processor).

In exemplary embodiments, the first modulator 112_1 and the second modulator 112_2 can be clocked with different edges of the same clock signal 118. By way of example, by the respective operating state it is possible to stipulate which MEMS microphone is sampled with the rising edge (e.g. first operating state) and which MEMS microphone with the falling edge (e.g. second operating state) of the clock signal (e.g. clock). For example, with a configuration bit (select L/R) or a control signal 116, it is possible to stipulate which MEMS microphone is sampled with the rising edge and which MEMS microphone with the falling edge of the clock signal (e.g. clock).

Detailed exemplary embodiments of the microphone module shown in FIG. 3 are described more specifically below.

Figure 4:
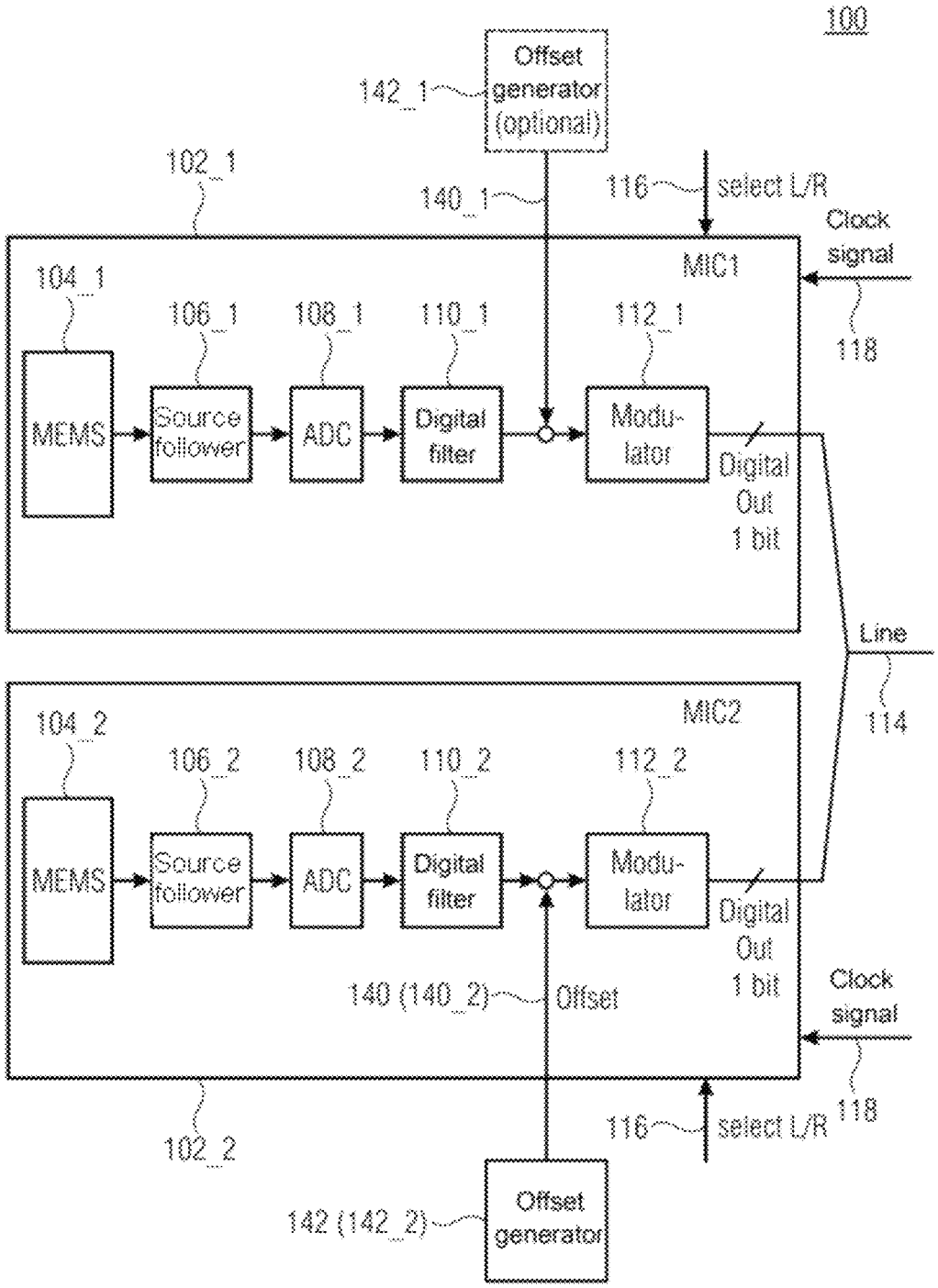
FIG. 4 shows a schematic block diagram of the microphone module shown in FIG. 2, wherein the microphone module furthermore comprises an offset generator connected to an input of the second modulator.

In order to reduce (or even to minimize) the stereo noise, a first configuration in accordance with FIG. 4 is proposed with the assumption that minimal or no analog offsets occur. FIG. 4 shows a block diagram of a stereo mode application with stereo noise reduction. In a MEMS microphone 102_1 or 102_2 (e.g. depending on select L/R 116), an offset is intentionally added which is large enough to ensure that the difference in the frequencies of the two limit cycles (of the first modulator 112_1 and of the second modulator 112_2) is sufficiently large. The stereo noise is thus shifted toward high frequencies and sufficiently damped by the thermoacoustic frequency response.

In detail, FIG. 4 shows a schematic block diagram of a microphone module 100 comprising a first MEMS microphone 102_1 and a second MEMS microphone 102_2, wherein the microphone module 100 furthermore comprises an offset generator 142, which can be connected to an input of the second modulator 112_2. The offset generator 142 can be configured to apply a defined offset 140 to the input of the second modulator 112_2.

Of course, in exemplary embodiments, it is equally possible for a defined offset 140 to be applied to the input of the first modulator 112_1 instead of the input of the second modulator 112_2. In this case, the offset generator 142 can be connected to the input of the first modulator 112_1, wherein the offset generator 142 can be configured to apply a defined offset 140 to the input of the first modulator 112_1.

In exemplary embodiments, the microphone module 100 can also comprise two offset generators 142_1 and 142_2; in detail, a first offset generator 142_1, which can be connected to an input of the first modulator 112_1, and a second offset generator 142_2, which can be connected to an input of the second modulator 112_2. The first offset generator 142_1 can be configured to apply a first offset 140_1 to the input of the first modulator 112_1, wherein the second offset generator 142_2 can be configured to apply a second defined offset 140_2 to the input of the second modulator 112_2.

In this case, the first offset generator 142_1 and the second offset generator 142_2 can be configured to apply different defined offsets to the respective inputs of the first modulator 112_1 and of the second modulator 112_2. By way of example, the first offset generator 142_1 and the second offset generator 142_2 can be configured to adapt the first offset 140_1 and the second offset 140_2 in such a way that limit cycles of the first modulator and of the second modulator differ by at least the factor 1.5 (or 1.7, or 2). As a result, the stereo noise can be shifted toward high frequencies and be sufficiently damped by the thermoacoustic frequency response.

As already mentioned above, in exemplary embodiments, the first MEMS microphone 102_1 and the second MEMS microphone 102_2 can be switchable in each case between a first operating state and a second operating state, wherein the first offset generator 142_1 can be configured to apply the defined offset to the input of the first modulator 112_1 only if the first MEMS microphone 102_1 is switched into the first operating state (e.g. if the first control signal 116_1 or the first control value indicates the first operating state) and the second MEMS microphone 102_2 is switched into the second operating state (e.g. if the second control signal 116_2 or the second control value indicates the second operating state), wherein the second offset generator 142_2 can be configured to apply the defined offset to the input of the second modulator 112_2 only if the second MEMS microphone 102_2 is switched into the first operating state (e.g. if the second control signal 116_2 or the second control value indicates the first operating state) and the first MEMS microphone 102_1 is switched into the second operating state (e.g. if the first control signal 116_2 or the first control value indicates the second operating state). In this case, the first defined offset 140_1 and the second defined offset 140_2 can also have the same value, such as e.g. −60 dBFS or more (or 50 dBFS or more, or −45 dBFS or more, or −40 dBFS or more, or −35 dBFS or more), since the defined offset is only ever applied simultaneously to the input of one of the modulators 112_1 or 112_2. Of course, the first offset 140_1 and the second offset 140_2 can also be different.

In other words, depending on select L/R 116, therefore, a defined offset 140 can intentionally be introduced in the case of one microphone (e.g. 102_2), while no defined offset 140 is introduced in the case of the second microphone (e.g. 102_1). As a result of the intentionally introduced offset, the difference in the frequencies of the limit cycles can be set such that the stereo noise is reduced (or even minimized).

Figure 5:
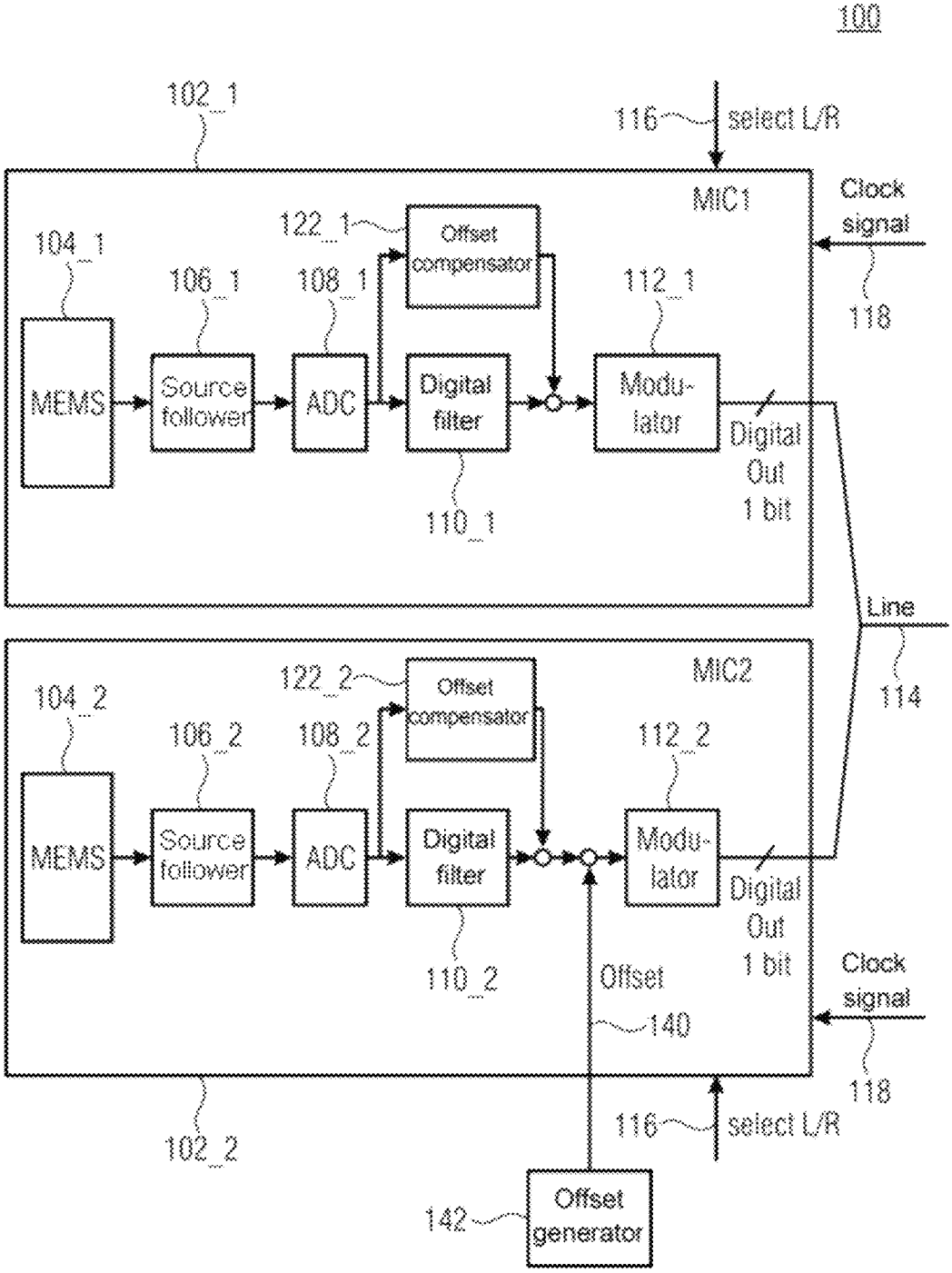
FIG. 5 shows a schematic block diagram of a microphone module comprising a first MEMS microphone and a second MEMS microphone, wherein the first MEMS microphone comprises a first offset compensator, and wherein the second MEMS microphone comprises a second offset compensator, in order to reduce analog offsets generated by the microphone module itself.

In the case of dominant analog offsets, the arrangement in accordance with FIG. 5 can be used. In detail, FIG. 5 shows a schematic block diagram of a microphone module 100 comprising a first MEMS microphone 102_1 and a second MEMS microphone 102_2, wherein the first MEMS microphone 102_1 comprises a first offset compensator 122_1, and wherein the second MEMS microphone comprises a second offset compensator 122_2. In other words, FIG. 5 shows a block diagram of a stereo mode application with modified stereo noise reduction.

The first offset compensator 122_1 can be connected to the input of the first modulator 112_1, wherein the first offset compensator 122_1 can be configured to reduce an analog offset generated by the microphone module 100 or by the first MEMS microphone 102_1 (or by the digital part of the first MEMS microphone 102_1) itself. The second offset compensator 122_2 can be connected to the input of the second modulator 112_2, wherein the second offset compensator 122_2 can be configured to reduce an analog offset generated by the microphone module 100 or by the second MEMS microphone 102_2 (or by the digital part of the second MEMS microphone 102_2) itself.

The unknown analog offset can thus be reduced (or even minimized) by digital offset compensation, wherein a sufficiently large offset 140 is added in one microphone, as has already been explained thoroughly with reference to FIG. 4. In principle, any form of offset compensation is possible. Generally, the analog offsets can also be left, provided that it is ensured that the intentionally added offset 140 is sufficiently large.

In accordance with a further exemplary embodiment, the first MEMS microphone 102_1 and the second MEMS microphone 102_2 can be switchable in each case between a first operating state and a second operating state, wherein the first MEMS microphone 102_1 and the second MEMS microphone 102 are switched into different operating states. In this case, the first offset generator (142_1) can be configured to apply a defined first offset to the input of the first modulator 112_1 if the first MEMS microphone 102_1 is switched into the first operating state, and to apply a defined second offset to the input of the first modulator 112_1 if the first MEMS microphone is switched into the second operating state. The second offset generator 142_2 can be configured to apply the defined first offset to the input of the second modulator 112_2 if the second MEMS microphone 102_2 is switched into the first operating state, and to apply the defined second offset to the input of the second modulator 112_2 if the second MEMS microphone 102_2 is switched into the second operating state. In this case, the defined first offset and the defined second offset are different, and different than zero.

In this case, the first MEMS microphone 102_1 and the second MEMS microphone 102_2 can be switched into the respective operating state by a control signal 116 present at the respective MEMS microphone 102_1, 102_2 and/or by a control value (select L/R) present at the respective MEMS microphone 102_1, 102_2.

By way of example, the first MEMS microphone 102_1 and the second MEMS microphone 102_2 can be allocated to different channels of a multi-channel application by the different operating states. For example, in a stereo application, the first operating state can allocate the respective MEMS microphone to a right channel (or left channel), while the second operating state can allocate the respective MEMS microphone to a left channel (or right channel).

In exemplary embodiments, the first MEMS microphone 102_1 and the second MEMS microphone 102_2 can be switched into the respective operating state for example by a control signal 116 present at the respective MEMS microphone or by a control value (select L/R) present at the respective MEMS microphone.

The modulators 112_1 and 112_2 shown in FIGS. 1 to 4 are digital modulators, for example. In this case, the defined offset 140 applied to the input of the second modulator 112_2 (or alternatively to the input of the first modulator 112_1) can be a digital word.

Figure 6:
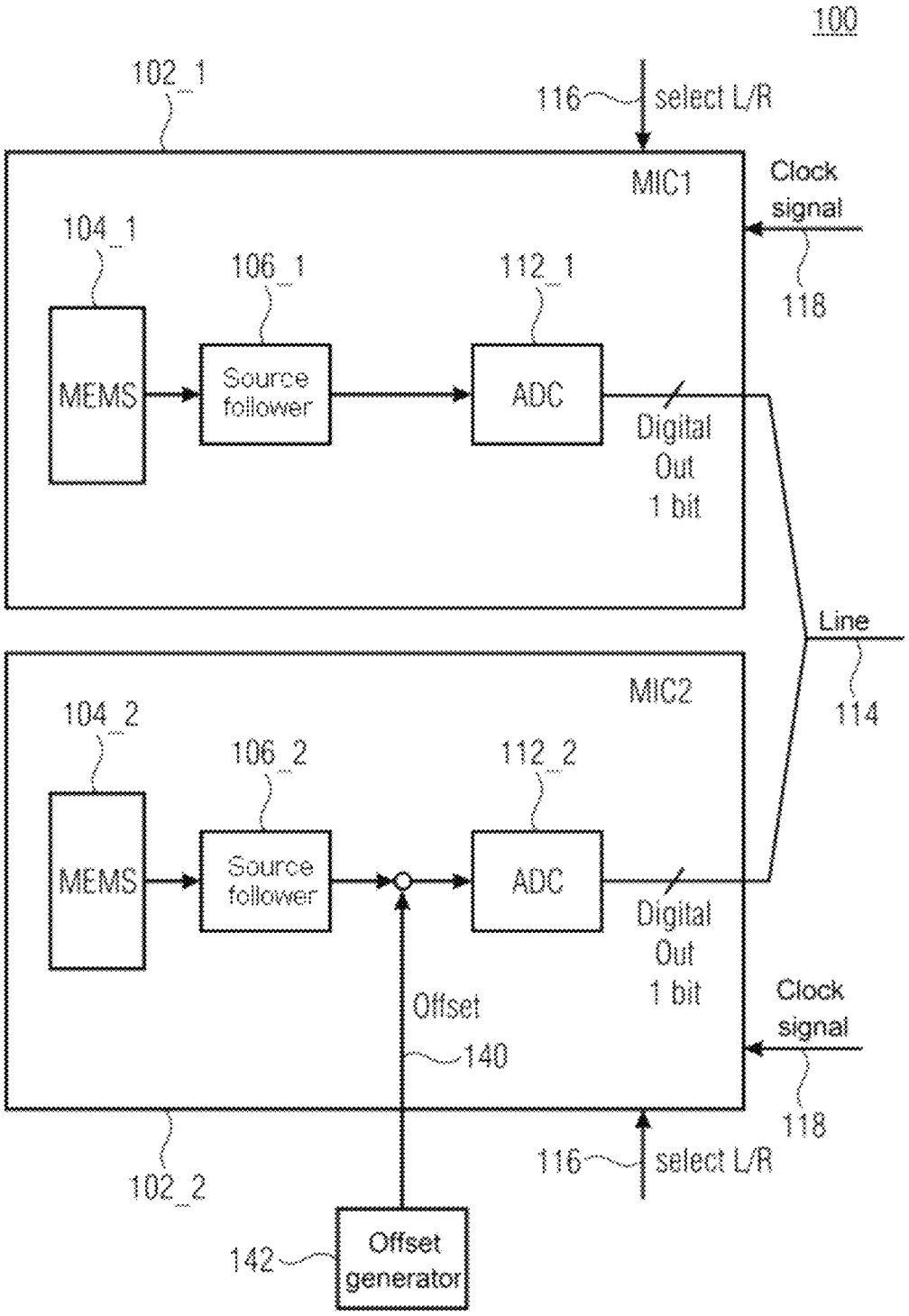
FIG. 6 shows a schematic block diagram of a microphone module comprising a first MEMS microphone and a second MEMS microphone, wherein instead of the digital part analog-to-digital converters are used as modulators.

FIG. 6 illustrates a further embodiment (low power application). In this case, no digital part is present and an analog offset is provided in one microphone. The relationships explained above are applicable in this application as well.

In detail, FIG. 6 shows a schematic block diagram of a microphone module 100 comprising a first MEMS microphone 102_1 and a second MEMS microphone 102_2, wherein instead of the digital part (i.e. the respective analog-to-digital converter 108_1 and 108_2, the respective digital filter 110_1 and 110_2, and the respective digital modulator 112_1 and 112_2), analog-to-digital converters 112_1 and 112_2 are used as modulators. In this case, an input of the first analog-to-digital converter 112_1 can be connected to the first amplifier unit 106_1, while an output of the first analog-to-digital converter 112_1 can be connected to the signal line 114. An input of the second analog-to-digital converter 112_2 can be connected to the second amplifier unit 106_2, while an output of the second analog-to-digital converter 112_2 can likewise be connected to the signal line 114.

In the exemplary embodiment shown in FIG. 6, the offset generator 142 can be configured to apply a defined analog offset 140 to the input of the second modulator (=second analog-to-digital converter) 112_2.

Figure 7:
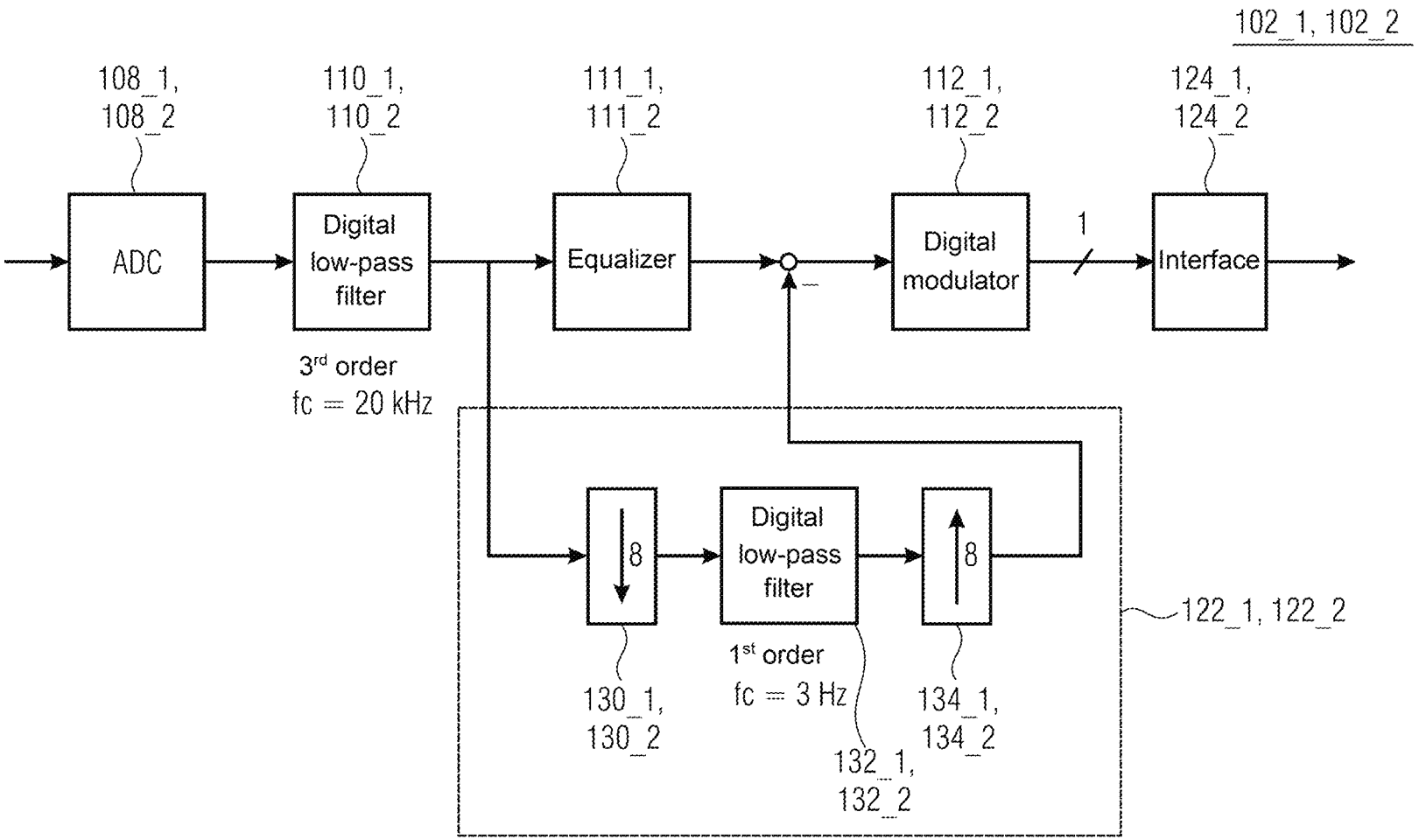
FIG. 7 shows a schematic block diagram of the respective MEMS microphones of an exemplary microphone module.

A detailed exemplary embodiment of an exemplary microphone module 100 comprising a first MEMS microphone 102_1 and a second MEMS microphone 102_2 is described below with reference to FIG. 7. In detail, FIG. 7 shows a schematic block diagram of the respective MEMS microphone 102_1 and 102_2 of the exemplary microphone module 100. In other words, FIG. 7 shows a block diagram of the digital filter path of the respective MEMS microphone.

The respective MEMS microphones 102_1 and 102_2 can comprise the respective analog-to-digital converters 108_1 and 108_2, the respective digital filters 110_1 and 110_2, the respective modulators 112_1 and 112_2, and the respective offset compensators 122_1 and 122_2. Furthermore, the MEMS microphones 102_1 and 102_2 can furthermore each comprise a digital equalizer 111_1 and 111_2, which is connected between the respective digital filter 110_1 and 110_2 and the respective digital modulator 112_1 and 112_2, wherein the respective offset compensator 122_1 and 122_2 can be connected in parallel with the digital equalizer between the respective digital filter 110_1 and 110_2 and the respective digital modulator 112_1 and 112_2. Furthermore, the MEMS microphones 102_1 and 102_2 can each comprise an interface (IF) block 124_1 and 124_2, which is connected to the output of the respective modulator 112_1 and 112_2. The respective MEMS microphone units 104_1 and 104_2 and the respective amplifier units 106_1 and 106_2 are not illustrated in FIG. 7, for the sake of clarity.

As can be discerned in FIG. 7, the respective digital filter 110_1 and 110_2 can be a digital low-pass filter, e.g. a third-order digital low-pass filter having a filter frequency fc of 20 kHz.

In order to ensure that the unknown analog offset is restricted to the range of e.g. +/70 dBFS, the offset compensation shown in FIG. 7 can be used, for example. In this case, the respective offset compensators 122_1 and 122_2 can comprise a first sampling rate converter 130_1 and 130_2, a digital low-pass filter 132_1 and 132_2, and a second sampling rate converter 134_1 and 134_2. The respective first sampling rate converter 130_1 and 130_2 can be configured to reduce the sampling rate by the factor 8 (or 10, or 6, or 4), for example. The respective digital low-pass filter 132_1 and 132_2 can be a first-order digital low-pass filter having a filter frequency of e.g. 3 Hz (or 2 Hz, or 4 Hz, or 10 Hz). The respective second sampling rate converter 134_1 and 134_2 can be configured to increase the sampling rate again by the factor 8 (or 10, or 6, or 4), for example.

Figure 8:
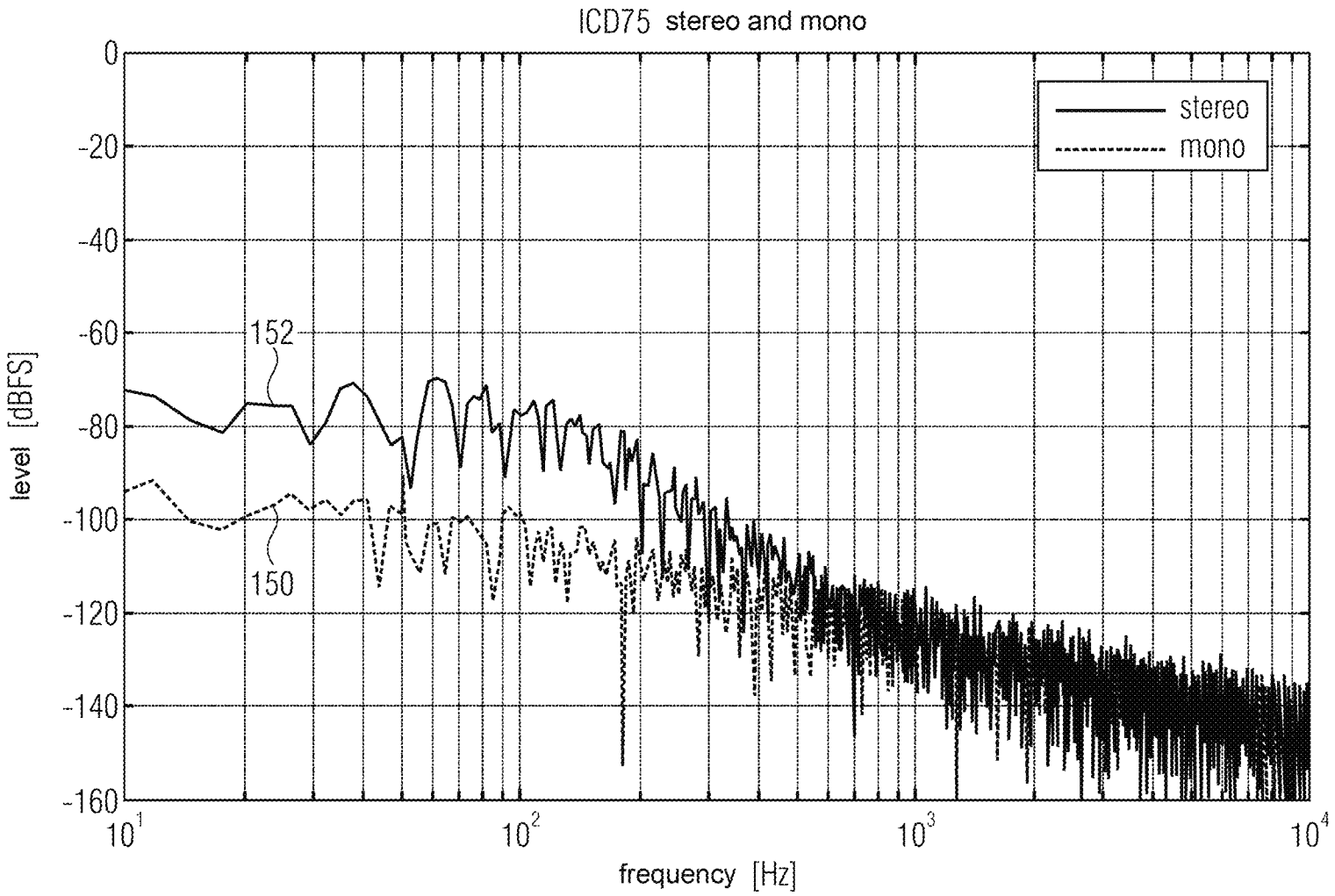
FIG. 8 shows in a diagram a profile of the stereo noise plotted against the frequency when the offset at the modulators is identical in the case of both MEMS microphones (stereo), and for comparison a profile of the stereo noise plotted against the frequency in the case of only one MEMS microphone (mono)
Figure 9:
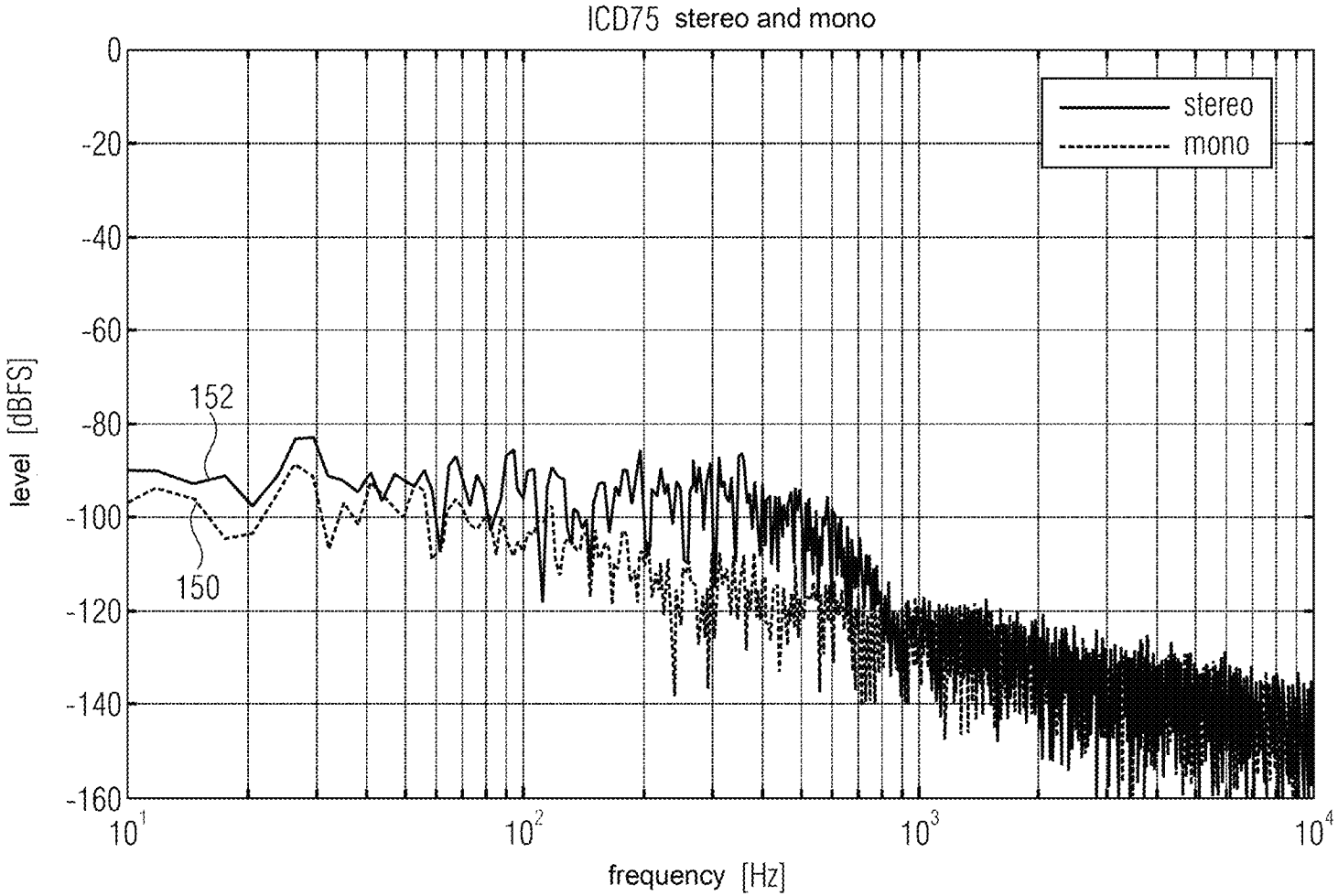
FIG. 9 shows in a diagram a profile of the stereo noise plotted against the frequency when a dominant offset of −70 dBFS is applied to the input of one of the modulators of the two MEMS microphones (stereo), and for comparison of a profile of the stereo noise plotted against the frequency in the case of only one MEMS microphone (mono)
Figure 10:
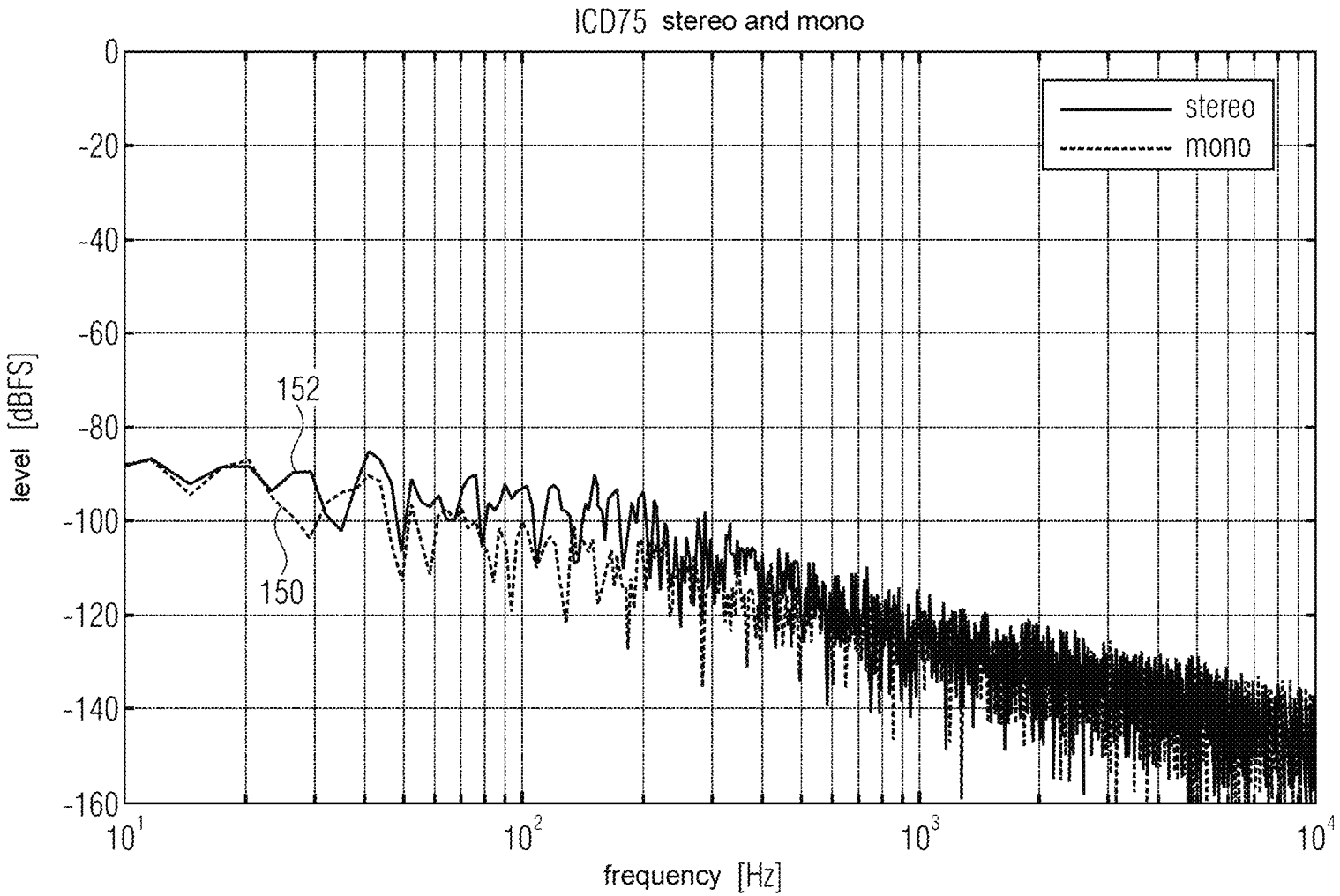
FIG. 10 shows in a diagram a profile of the stereo noise plotted against the frequency when different offsets of −70 dBFS and −46 dBFS are applied to the inputs of the modulators of the two MEMS microphones (stereo), and for comparison a profile of the stereo noise plotted against the frequency in the case of only one MEMS microphone.

Simulation results of the exemplary microphone module comprising two MEMS microphones 102_1 and 102_2 as shown in FIG. 7 are illustrated in FIGS. 8 to 10.

FIG. 8 shows in a diagram a profile of the stereo noise 152 plotted against the frequency when the offset is identical in the case of both modulators of the MEMS microphones 102_1 and 102_2 (stereo), and for comparison a profile of the stereo noise 150 plotted against the frequency in the case of only one MEMS microphone (mono). In other words, FIG. 8 shows the stereo noise when the offset is identical in the case of both MEMS microphones (very small offset of −100 dBFS (both MEMS microphones)). It can be discerned in FIG. 8 that the stereo noise occurs in the DC range.

FIG. 9 shows in a diagram a profile of the stereo noise 152 plotted against the frequency when a dominant offset of −70 dBFS is applied to the input of one of the modulators 112_1 and 112_2 of the two MEMS microphones 102_1 and 102_2 (stereo), and for comparison a profile of the stereo noise 150 plotted against the frequency in the case of only one MEMS microphone (mono). In other words, FIG. 9 shows by contrast the stereo noise at higher frequencies when MIC1 has offset=0 and MIC2 offset=−70 dBFS.

FIG. 10 shows in a diagram a profile of the stereo noise 152 plotted against the frequency when different offsets of −70 dBFS and −46 dBFS are applied to the inputs of the modulators 112_1 and 112_2 of the two MEMS microphones 102_1 and 102_2 (stereo), and for comparison a profile of the stereo noise 150 plotted against the frequency in the case of only one MEMS microphone (mono). In other words, FIG. 10 shows the minimized stereo noise when a dominant digital offset (−46 dBFS) is intentionally added in one MEMS microphone, while the other MEMS microphone has an offset of less than −70 dBFS.

Figure 11:
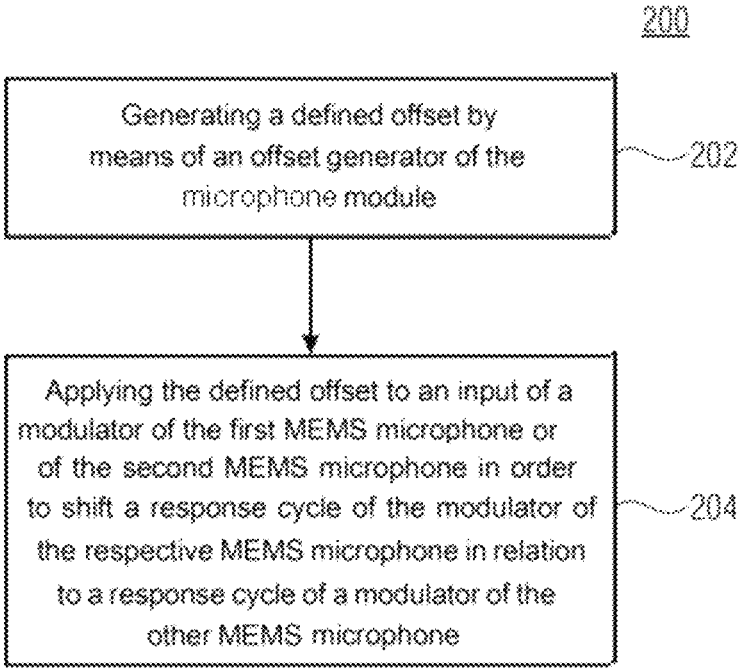
FIG. 11 shows a flow diagram of a method for operating a microphone module comprising a first MEMS microphone and a second MEMS microphone.

FIG. 11 shows a flow diagram of a method 200 for operating a microphone module comprising a first MEMS microphone and a second MEMS microphone. The method 200 comprises a step 202 of generating a defined offset by an offset generator of the microphone module. The method furthermore comprises a step 204 of applying the defined offset to an input of a modulator of the first MEMS microphone or of the second MEMS microphone in order to shift a response cycle of the modulator of the respective MEMS microphone in relation to a response cycle of a modulator of another MEMS microphone.

A second aspect of the claimed subject matter is described below.

As already mentioned above, the stereo noise is determined principally by the limit cycles of the digital modulators (see FIG. 2) in addition to other parameters (e.g. supply voltage). In principle, in the case of 1-bit (single bit) modulators, strong limit cycles occur around Fs/2. If the frequencies of the limit cycles correspond, then stereo noise arises in the DC range. If the frequencies of the limit cycles are different, then depending on the difference in the frequencies of the limit cycles, the stereo noise is shifted toward higher frequencies and weighted with the thermoacoustic frequency response.

Figure 12:
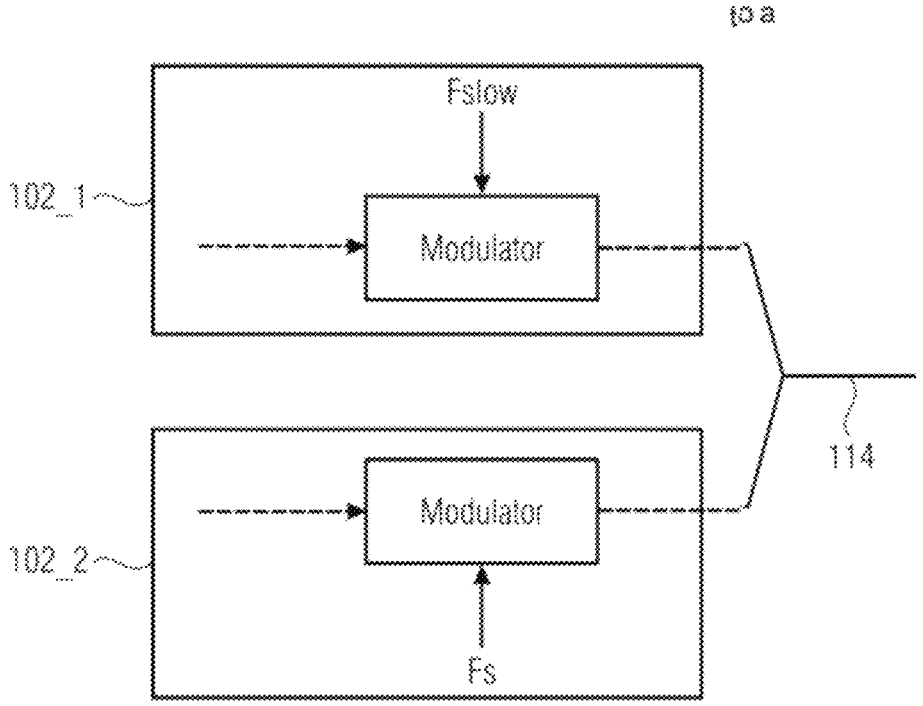
FIG. 12 shows a schematic block diagram of a microphone module comprising a first MEMS microphone and a second MEMS microphone, wherein modulators of the first MEMS microphone and of the second MEMS microphone are clocked with different clock frequencies.

By way of example, the microphone module 100 shown in FIG. 12 can be used for reducing the stereo noise.

FIG. 12 shows a schematic block diagram of a microphone module 100 comprising a first MEMS microphone 102_1 and a second MEMS microphone 102_2, wherein the first modulator 112_1 of the first MEMS microphone 102_1 is clocked with a first clock frequency Fs1, and wherein the second modulator 112_2 of the second MEMS microphone 102_2 is clocked with a second clock frequency Fs2, wherein the first clock frequency Fs1 and the second clock frequency Fs2 are different.

In exemplary embodiments, the first clock frequency Fs1 and the second clock frequency Fs2 can differ by at least the factor 1.1, or 1.3, or 1.5, or 1.7, or 2, or 2.2, or 2.5. By way of example, the first clock frequency Fs1 can be reduced relative to the second clock frequency Fs2 (or vice versa), for example by at least the factor 1.1, or 1.3, or 1.5, or 1.7, or 2, or 2.2, or 2.5.

In exemplary embodiments, the first clock frequency Fs1 and the second clock frequency Fs2 can differ from one another in such a way that limit cycles of the first modulator 112_1 and of the second modulator 112_2 differ by at least 5 kHz (or 7 kHz, or 8 kHz, or 10 kHz, or 15 kHz, or 20 kHz). By way of example, the first clock frequency Fs1 can be reduced relative to the second clock frequency Fs2 (or vice versa) in such a way that limit cycles of the first modulator 112_1 and of the second modulator 112_2 differ by at least 5 kHz (or 7 kHz, or 8 kHz, or 10 kHz, or 15 kHz, or 20 kHz).

In exemplary embodiments, the first modulator 112_1 and the second modulator 112_2 can be 1-bit (single bit) modulators, i.e. modulators that provide only one bit (as sample) at the output per clock cycle of a clock signal 118.

As already mentioned, in exemplary embodiments, one of the two modulators 112_1 or 112_2 can be operated with a reduced clock frequency. In this case, which modulator 112_1 or 112_2 is operated with a reduced clock frequency can be dependent on the respective operating state of the two MEMS microphones 102_1 and 102_2.

In detail, in exemplary embodiments, the first MEMS microphone 102_1 and the second MEMS microphone 102_2 can be switchable (in each case) between a first operating state and a second operating state. In this case, the first MEMS microphone 102_1 and the second MEMS microphone 102_2 should be switched into different operating states, i.e. the first MEMS microphone 102_1 into the first operating state and the second MEMS microphone into the second operating state, or the first MEMS microphone 102_1 into the second operating state and the second MEMS microphone into the first operating state.

In exemplary embodiments, the first modulator 112_1 can be clocked with a reduced clock frequency or be clocked with a first clock frequency Fs1 reduced relative to the second clock frequency Fs2 if the first MEMS microphone 102_1 is switched into a first operating state (and the second MEMS microphone 102_2 is switched into a second operating state), while the second modulator 112_2 can be clocked with a reduced clock frequency or can be clocked with a second clock frequency Fs2 reduced relative to the first clock frequency Fs1 if the second MEMS microphone 102_2 is switched into the first operating state (and the first MEMS microphone 102_1 is switched into the second operating state).

By way of example, the first MEMS microphone 102_1 and the second MEMS microphone 102_2 can be allocated to different channels of a multi-channel application by the different operating states. For example, in a stereo application, the first operating state can allocate the respective MEMS microphone to a right channel (or left channel), while the second operating state can allocate the respective MEMS microphone to a left channel (or right channel).

In exemplary embodiments, the first MEMS microphone 102_1 and the second MEMS microphone 102_2 can be switched into the respective operating state for example by a control signal 116 present at the respective MEMS microphone or by a control value (select L/R) present at the respective MEMS microphone.

In exemplary embodiments, outputs of the MEMS microphones 102_1 and 102_2, or in detail outputs of the first modulator 112_1 and of the second modulator 112_2, can be connected to the same line or data line 114 and thus be connected via the same line 114 for example to a downstream signal processing device, such as e.g. a DSP (DSP=digital signal processor).

In exemplary embodiments, the first MEMS microphone 102_1 and the second MEMS microphone 102_2 can provide output values with the same sampling rate.

For this purpose, by way of example, the first MEMS microphone 102_1 can comprise a first sampling rate converter 113_1 which can be connected downstream of the first modulator 112_1 (e.g. depending on the respective operating state), wherein the first sampling rate converter 113_2 can be configured to convert a first sampling rate 1/Fs1 based on the first clock frequency Fs1 to a second sampling rate 1/Fs2 based on the second clock frequency Fs2. In exemplary embodiments, the first sampling rate converter 113_1 can be connected downstream of the first modulator 112_1 here only in the first operating state (e.g. right channel), while the first sampling rate converter 113_1 can be bridged in the second operating state (e.g. left channel).

Alternatively or additionally, the second MEMS microphone 102_2 can also comprise a second sampling rate converter 113_2, which can be connected downstream of the second modulator 112_2 (e.g. depending on the respective operating state), wherein the second sampling rate converter 113_2 can be configured to convert a second sampling rate 1/Fs2 based on the second clock frequency Fs2 to a first sampling rate 1/Fs1 based on the first clock frequency Fs1. In exemplary embodiments, the second sampling rate converter 113_2 can be connected downstream of the second modulator 112_2 here only in the first operating state (e.g. right channel), while the second sampling rate converter 113_2 can be bridged in the second operating state (e.g. left channel).

In exemplary embodiments, the first MEMS microphone 102_1 and the second MEMS microphone 102_2, more specifically the respective modulators 112_1 and 112_2 or sampling rate converters of the first MEMS microphone 102_1 and of the second MEMS microphone 102_2, can be configured to provide a (binary) sample at the respective output in response to different edges (e.g. rising edge and falling edge) of the clock signal, which can have for example the second clock frequency Fs2.

Detailed exemplary embodiments of the microphone module 100 shown in FIG. 12 are described more specifically below. It is assumed here by way of example that the first clock frequency Fs1 (Fslow) is reduced relative to the second clock frequency Fs2 (Fs).

Figure 13:
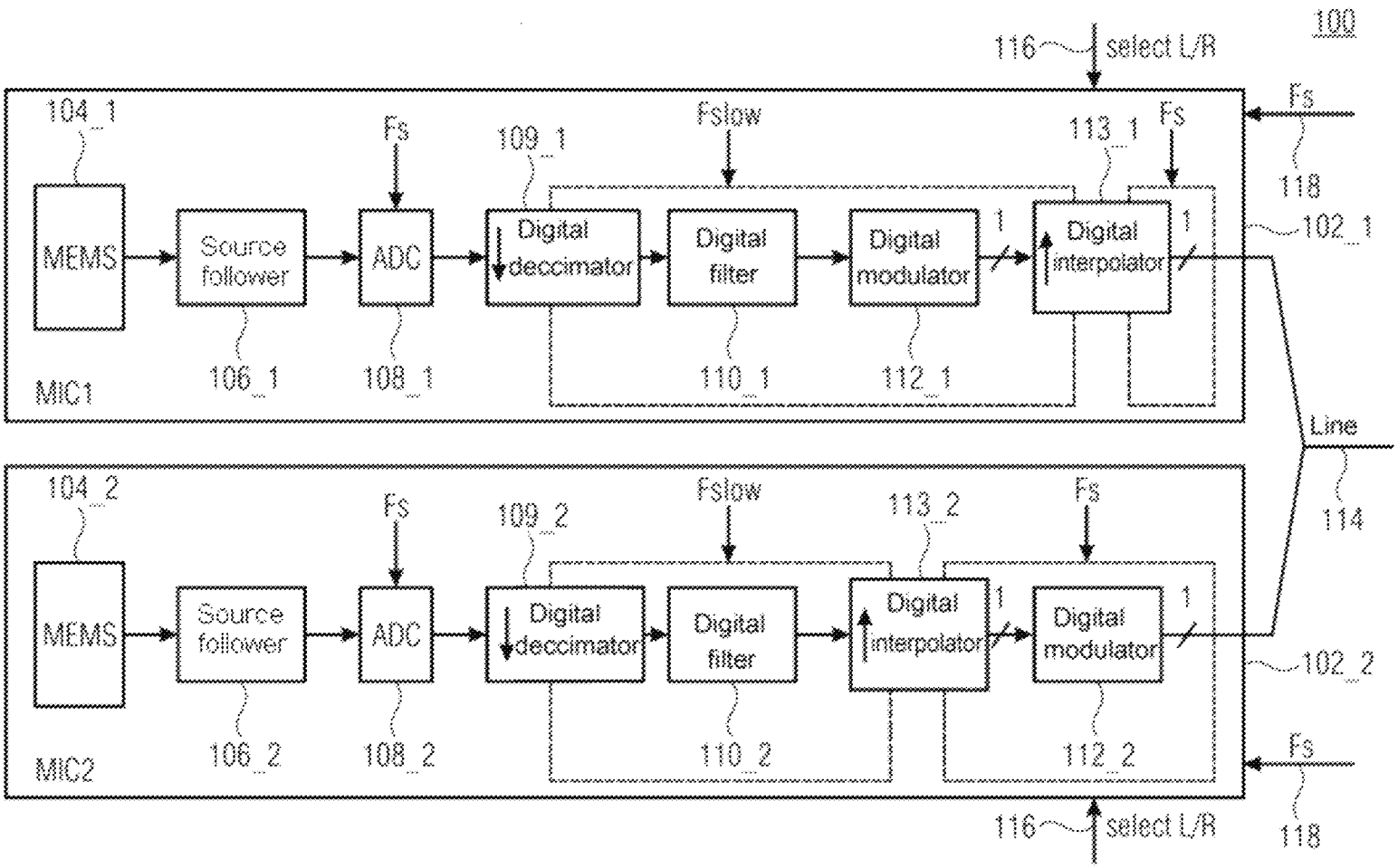
FIG. 13 shows a schematic block diagram of a microphone module comprising a first MEMS microphone and a second MEMS microphone, wherein the first digital modulator of the first MEMS microphone is clocked with a first clock frequency, wherein the second digital modulator of the second MEMS microphone is clocked with a second clock frequency, wherein the first clock frequency is reduced relative to the second clock frequency.

FIG. 13 shows a schematic block diagram of a microphone module 100 comprising a first MEMS microphone 102_1 and a second MEMS microphone 102_2, wherein the first digital modulator 112_1 of the first MEMS microphone 102_1 is clocked with a first clock frequency Fslow, and wherein the second digital modulator 112_2 of the second MEMS microphone 102_2 is clocked with a second clock frequency Fs, wherein the first clock frequency Fslow is reduced relative to the second clock frequency Fs. In other words, FIG. 13 shows a block diagram of a stereo mode application with stereo noise reduction.

In detail, the first MEMS microphone 102_1 comprises a first MEMS microphone unit 104_1, a first amplifier unit 106_1 (e.g. a source follower), a first analog-to-digital converter (ADC) 108_1, a first sampling rate converter 109_1, a first digital filter 110_1, the first digital modulator 112_1, and a first digital interpolator (sampling rate converter) 113_1.

The second MEMS microphone 102_1 comprises a second MEMS microphone unit 104_2, a second amplifier unit 106_2 (e.g. a source follower), a second analog-to-digital converter (ADC) 108_2, a second sampling rate converter 109_2, a second digital filter 110_2, a second digital interpolator 113_2 and the second digital modulator 112_2.

As can be discerned in FIG. 13, the first digital filter 110_1 and the first digital modulator 112_1 of the first MEMS microphone 102_1 can be clocked with the first clock frequency Fslow, while the first analog-to-digital converter 108_1 can be clocked with the second clock frequency Fs. The first sampling rate converter 109_1 can be configured to convert a second sampling rate 1/FS based on the second clock frequency Fs to a first sampling rate 1/Fslow based on the first clock frequency Fslow. The first digital interpolator (sampling rate converter) 113_1 can be connected downstream of the first digital modulator 112_1, wherein the first digital interpolator (sampling rate converter) 113_1 can be configured to convert the first sampling rate 1/Fslow based on the first clock frequency Fslow to the second sampling rate 1/Fs based on the second clock frequency Fs.

The second digital filter 110_2 of the second MEMS microphone 102_2 can be clocked with the first clock frequency Fslow, while the second analog-to-digital converter 108_2 and the second digital modulator 112_2 can be clocked with the second clock frequency Fs. The second sampling rate converter 109_2 can be configured to convert the second sampling rate 1/FS based on the second clock frequency Fs to the first sampling rate 1/Fslow based on the first clock frequency Fslow. The second digital interpolator (sampling rate converter) 113_2 can be connected upstream of the second digital modulator 112_2, wherein the second digital interpolator (sampling rate converter) 113_2 can be configured to convert the first sampling rate 1/Fslow based on the first clock frequency Fslow to the second sampling rate 1/Fs based on the second clock frequency Fs.

As is illustrated in FIG. 13, modulators 112_1 and 112_2 having different modulation frequencies can be used for the purpose of reducing (or even minimizing) the stereo noise. A modulation frequency Fslow can be used in one microphone (e.g. the first MEMS microphone 102_1; depending on select L/R 116_1) and a modulation frequency Fs can be used in the other microphone (e.g. the second MEMS microphone 102_2; depending on select L/R 116_2). In order that both MEMS microphones 102_1 and 102_2 supply the output data at the same sampling rate, a digital interpolation stage (in the implementation for example a simple repeater) can be used. It can thus be ensured that the difference in the frequencies of the two limit cycles (of the first modulator 112_1 and of the second modulator 112_2) is sufficiently large. The stereo noise can thus be shifted toward high frequencies and be sufficiently damped by the thermoacoustic frequency response.

Figure 14:
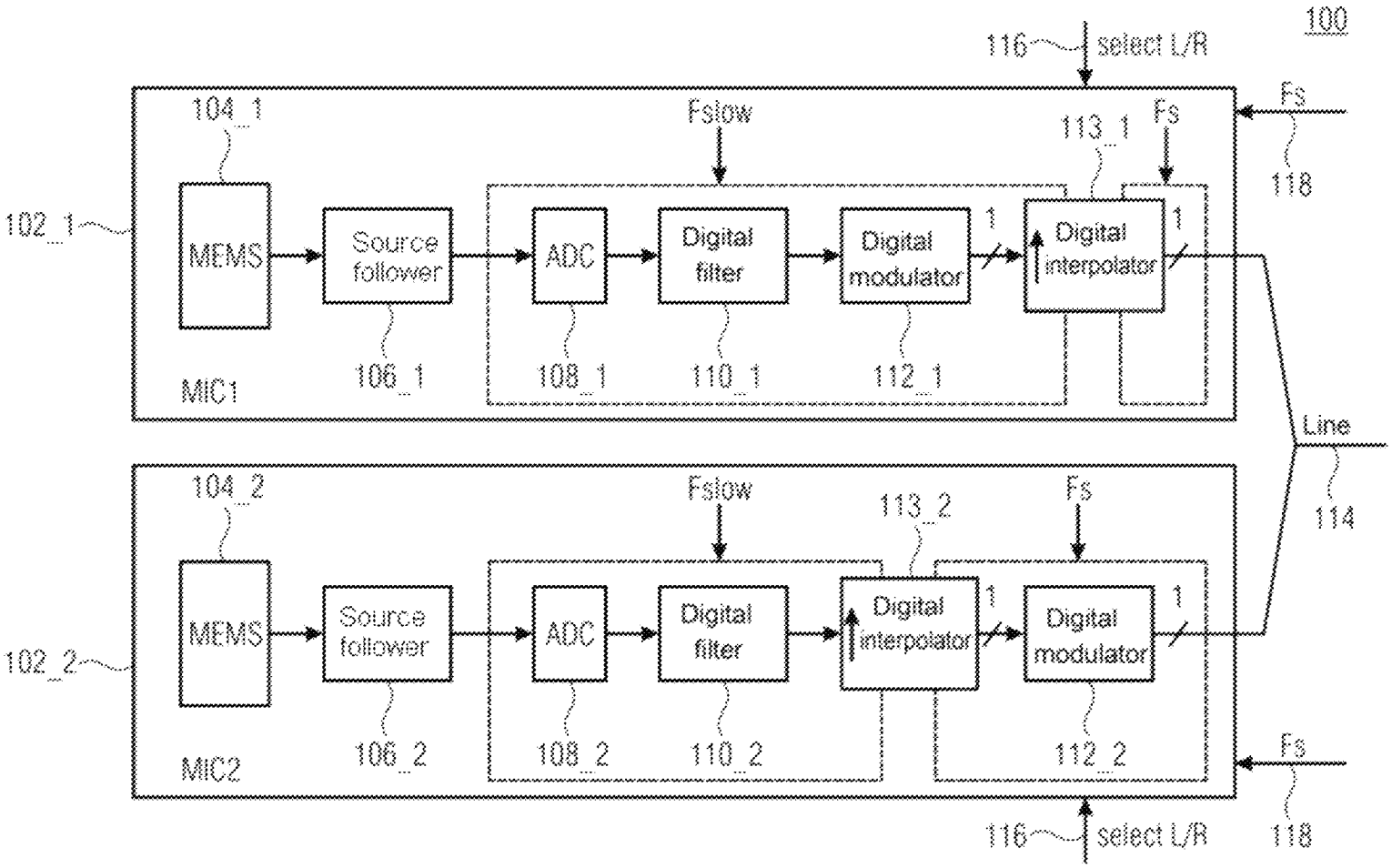
FIG. 14 shows a schematic block diagram of a microphone module comprising a first MEMS microphone and a second MEMS microphone, wherein the first digital modulator of the first MEMS microphone is clocked with a first clock frequency, wherein the second digital modulator of the second MEMS microphone is clocked with a second clock frequency, wherein the first clock frequency is reduced relative to the second clock frequency.

FIG. 14 shows a schematic block diagram of a microphone module 100 comprising a first MEMS microphone 102_1 and a second MEMS microphone 102_2, wherein the first digital modulator 112_1 of the first MEMS microphone 102_1 is clocked with a first clock frequency Fslow, and wherein the second digital modulator 112_2 of the second MEMS microphone 102_2 is clocked with a second clock frequency Fs, wherein the first clock frequency Fslow is reduced relative to the second clock frequency Fs. In contrast to the microphone module 100 shown in FIG. 13, in the case of the microphone module 100 shown in FIG. 14, the first analog-to-digital converter 108_1 of the first MEMS microphone 102_1 and the second analog-to-digital converter 108_2 of the second MEMS microphone 102_2 are also clocked with the first clock frequency Fs. The sampling rate converters 109_1 and 109_2 connected downstream of the analog-to-digital converters 108_1 and 108_2 can thus be dispensed with. In other words, FIG. 14 shows a further variant in which the ADCs 108_1 and 108_2 also operate at a lower sampling rate 1/Fslow (stereo mode application with modified stereo noise reduction).

Figure 15:
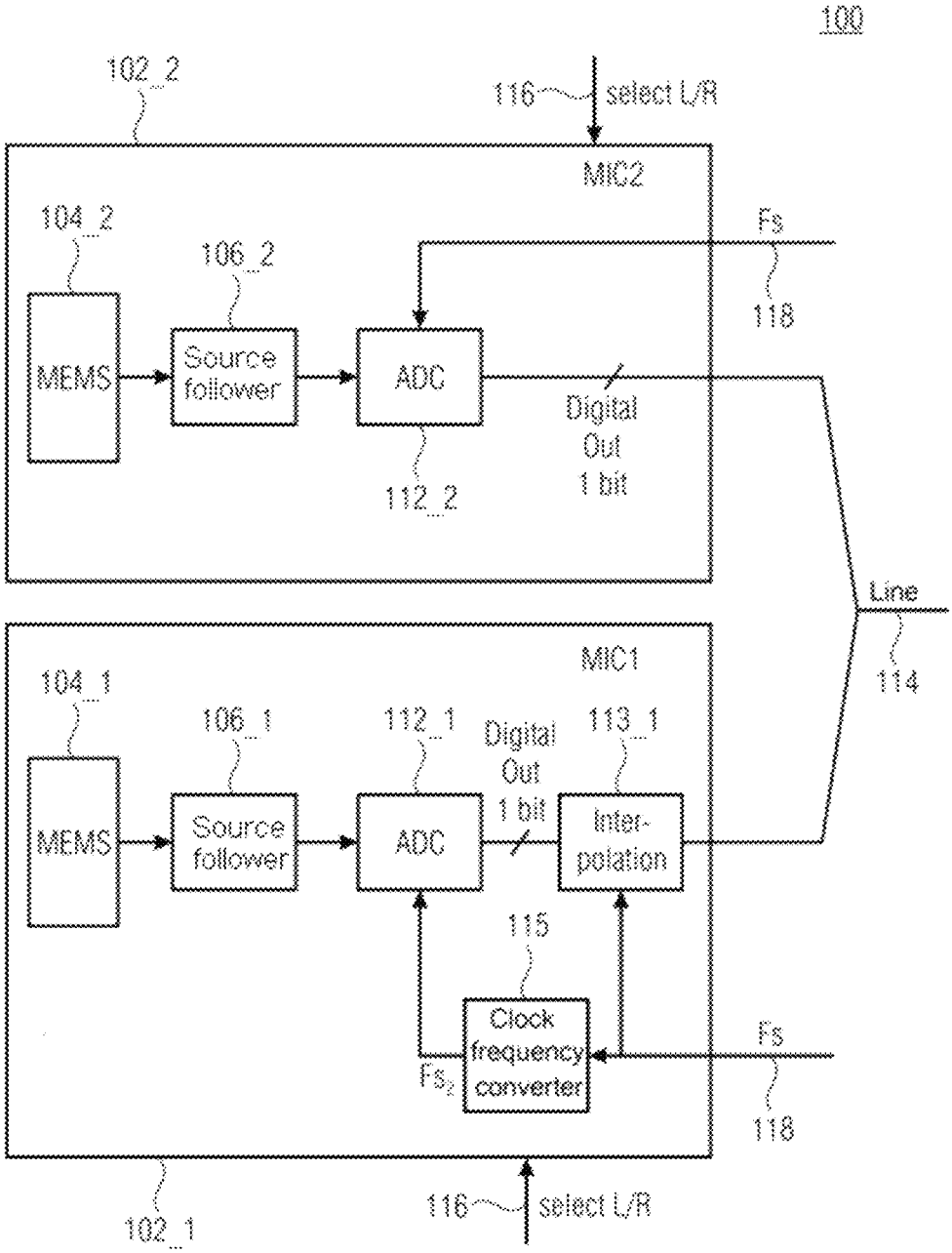
FIG. 15 shows a schematic block diagram of a microphone module comprising a first MEMS microphone and a second MEMS microphone, wherein instead of the digital parts analog-to-digital converters are used as modulators.

FIG. 15 shows a schematic block diagram of a microphone module 100 comprising a first MEMS microphone 102_1 and a second MEMS microphone 102_2, wherein instead of the digital parts (i.e. the respective analog-to-digital converter 108_1 and 108_2, the respective digital filter 110_1 and 110_2, and the respective digital modulator 112_1 and 112_2), analog-to-digital converters 112_1 and 112_2 are used as modulators. In this case, an input of the second analog-to-digital converter 112_2 can be connected to the second amplifier unit 106_2, while an output of the second analog-to-digital converter 112_2 can be connected to the signal line 114. An input of the first analog-to-digital converter 112_1 can be connected to the first amplifier unit 106_1, while an output of the first analog-to-digital converter 112_1 can be connected to the signal line 114 via an interpolation stage (sampling rate converter) 113_1. The interpolation stage (sampling rate converter) 113_1 can be configured to convert the first sampling rate 1/Fs2 based on the first clock frequency Fs2 to the second sampling rate 1/Fs based on the second clock frequency Fs. Furthermore, the first MEMS microphone 102_1 can comprise a clock frequency converter (clock adaptor) 115, which can be configured to convert the second clock frequency Fs to the first clock frequency Fs2.

In other words, FIG. 15 shows a block diagram of a stereo mode application with stereo noise reduction (low power application). In this case, no digital part is present and the two ADCs 112_1 and 112_2 operate at different sampling rates depending on the select L/R bit 116_1 and 116_2. The relationships explained above are applicable in this application as well.

As has been shown with reference to FIGS. 12 to 15, in exemplary embodiments, depending on select L/R 116, the modulation frequencies of the two MEMS microphones (or in detail the modulation frequencies of the two modulators 112_1 and 112_2) can be defined differently. Owing to this, the difference in the frequencies of the limit cycles can be set such that the stereo noise is reduced (or is minimized).

A detailed exemplary embodiment of an exemplary microphone module 100 comprising a first MEMS microphone 102_1 and a second MEMS microphone 102_1 is described below with reference to FIG. 16.

Figure 16:
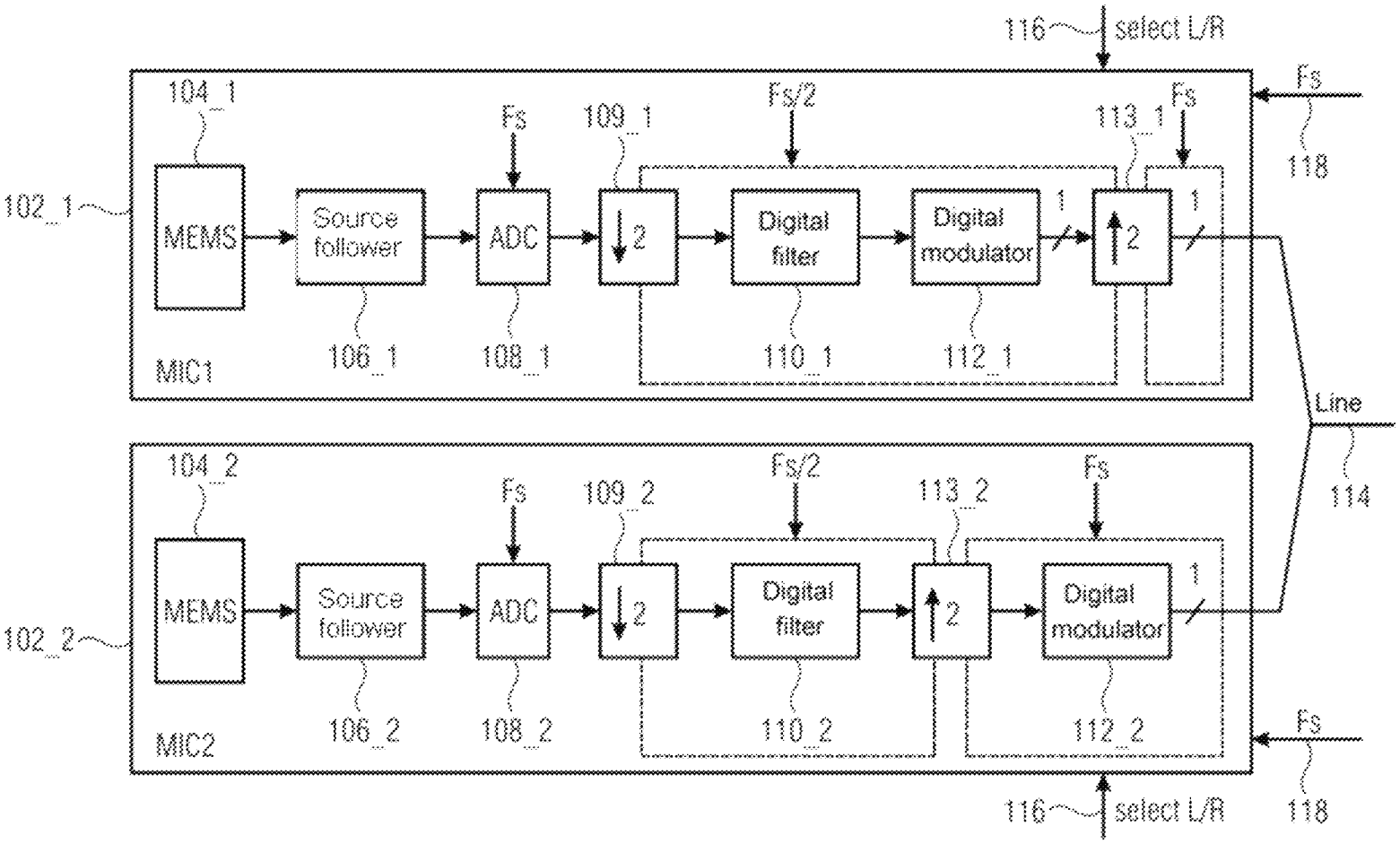
FIG. 16 shows a schematic block diagram of a microphone module comprising a first MEMS microphone and a second MEMS microphone, wherein the first digital modulator of the first MEMS microphone is clocked with a first clock frequency, wherein the second digital modulator of the second MEMS microphone is clocked with a second clock frequency, wherein the first clock frequency is reduced relative to the second clock frequency by the factor 2.

FIG. 16 shows a schematic block diagram of an exemplary microphone module 100 comprising a first MEMS microphone 102_1 and a second MEMS microphone 102_2, wherein a first modulator 112_1 of the first MEMS microphone 102_1 is clocked with a first clock frequency Fs, and wherein a second modulator 112_2 of the second MEMS microphone 102_2 is clocked with a second clock frequency Fs/2, which is reduced relative to the first clock frequency Fs by the factor 2. Accordingly, the first sampling rate converter 109_1 and the second sampling rate converter 109_2 can be configured in each case to convert the first sampling rate 1/Fs based on the first clock frequency Fs to the second sampling rate 1/(Fs/2) based on the second clock frequency Fs/2, wherein the second sampling rate 1/(Fs/2) is reduced relative to the first sampling rate 1/Fs by the factor 2. The first interpolation stage (sampling rate converter) 113_1 and the second interpolation stage (sampling rate converter) 113_2 can accordingly be configured to convert the second sampling rate 1/(Fs/2) again to the first sampling rate 1/Fs.

In other words, FIG. 16 shows a block diagram of a digital filter path of an exemplary microphone module 100. As can be discerned in FIG. 16, the first modulator 112_1 of the first MEMS microphone 102_1 can operate at FS/2, while the second modulator 112_2 of the second MEMS microphone 102_2 can operate at Fs. In order that both MEMS microphones 102_1 and 102_2 have the same sampling rate Fs at the interface, in the case of the first MEMS microphone 102_1 the interpolation can take place downstream of the first modulator 112_1, while in the case of the second microphone 102_2 the interpolation can take place upstream of the second modulator 112_2. The interpolation can be carried out here for example in each case by a repeater.

Figure 17:
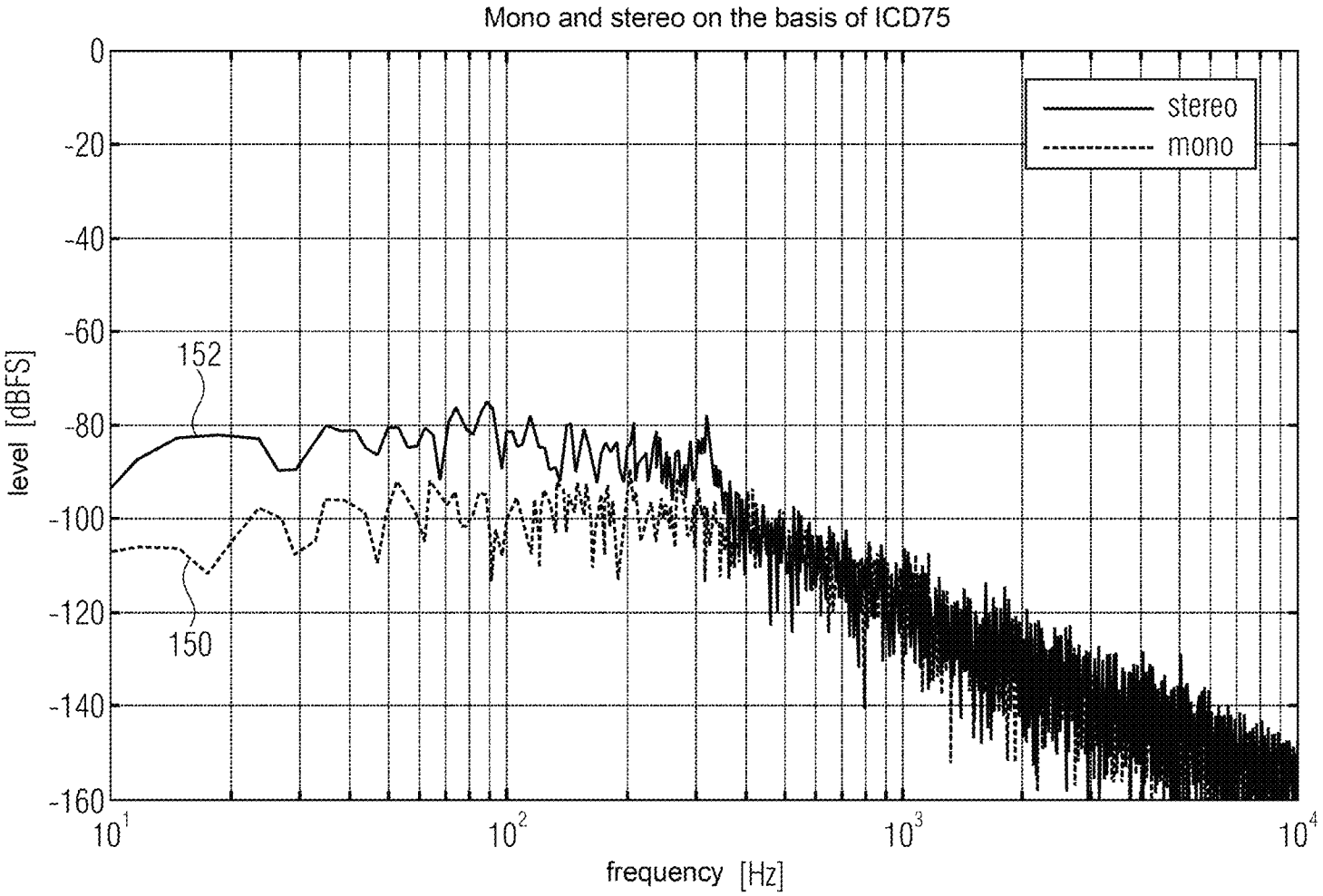
FIG. 17 shows in a diagram a profile of the stereo noise plotted against the frequency when the first modulator of the first MEMS microphone and the second modulator of the second MEMS microphone are clocked with the same clock frequency, and for comparison a profile of the stereo noise plotted against the frequency in the case of only one MEMS microphone.
Figure 18:
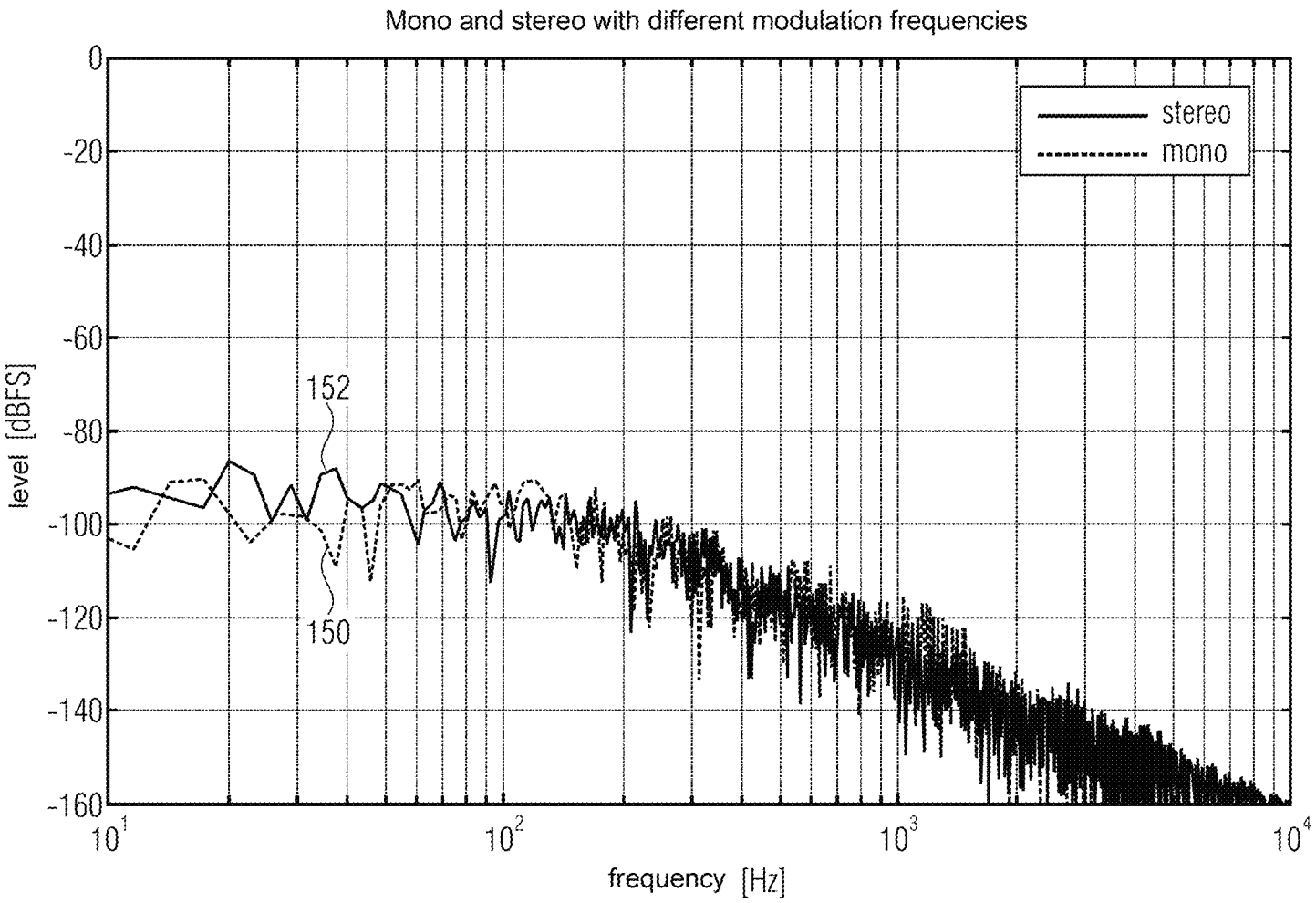
FIG. 18 shows in a diagram a profile of the stereo noise plotted against the frequency when the first modulator is clocked with a first clock frequency and the second modulator is clocked with the second clock frequency, wherein the first clock frequency is reduced relative to the second clock frequency by the factor, and for comparison a profile of the stereo noise plotted against the frequency in the case of only one MEMS microphone.

Simulation results of the exemplary microphone module 100 comprising two MEMS microphones 102_1 and 102_2 as shown in FIG. 16 are illustrated in FIGS. 17 to 18.

FIG. 17 shows in a diagram a profile of the stereo noise 152 plotted against the frequency when the first modulator 112_1 of the first MEMS microphone 102_1 and the second modulator 112_2 of the second MEMS microphone 102_2 are clocked with the same clock frequency (stereo), and for comparison a profile of the stereo noise 150 plotted against the frequency in the case of only one MEMS microphone (mono). In other words, FIG. 17 shows the stereo noise when the modulation frequency is identical in the case of both MEMS microphones. It can be discerned in FIG. 17 that the stereo noise occurs in the DC range.

FIG. 18 shows in a diagram a profile of the stereo noise 152 plotted against the frequency when the first modulator 112_1 of the first MEMS microphone 102_1 is clocked with a first clock frequency Fs/2 and the second modulator 112_2 of the second MEMS microphone 102_2 is clocked with a second clock frequency Fs, wherein the first clock frequency Fs/2 is reduced relative to the second clock frequency Fs by the factor 2 (stereo), and for comparison a profile of the stereo noise 150 plotted against the frequency in the case of only one MEMS microphone (mono). In other words, FIG. 18 shows the reduced stereo noise when different modulation frequencies in accordance with FIG. 16 are used.

Figure 19:
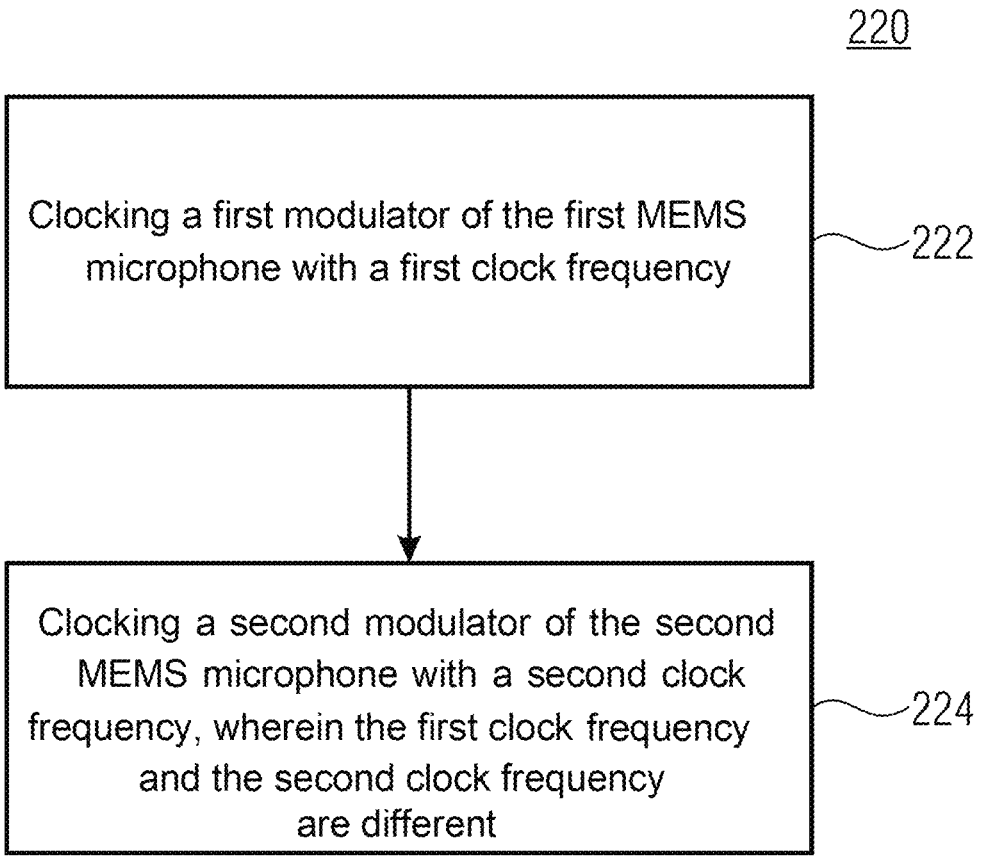
FIG. 19 shows a flow diagram of a method for operating a microphone module comprising a first MEMS microphone and a second MEMS microphone.

FIG. 19 shows a flow diagram of a method 220 for operating a microphone module comprising the first MEMS microphone and a second MEMS microphone. The method 220 comprises a step 222 of clocking a first modulator of the first MEMS microphone with a first clock frequency. Furthermore, the method 220 comprises a step 224 of clocking a second modulator of the second MEMS microphone with a second clock frequency, wherein the first clock frequency and the second clock frequency are different.

Exemplary embodiments provide a microphone application with stereo noise reduction by using different modulation frequencies.

Although specific embodiments have been illustrated and described here, it is obvious to the person of average skill in the art that a multiplicity of alternative and/or equivalent implementations can replace the specific embodiments shown and described, without departing from the scope of the present invention. This application is intended to cover all adaptations or variations of the specific embodiments discussed herein. Therefore, the intention is for this invention to be restricted only by the claims and the equivalents thereof.

What is claimed is:

1. A microphone module, comprising:

a first MEMS (Micro-Electro-Mechanical Systems) microphone, wherein the first MEMS microphone comprises a first modulator;

a second MEMS microphone, wherein the second MEMS microphone comprises a second modulator; and an offset generator, wherein the offset generator is directly connected to an input of the first modulator or of the second modulator, and wherein the offset generator is configured to apply a defined offset to the input of the first modulator or of the second modulator.

2. The microphone module as claimed in claim 1, wherein the offset generator is configured to adapt the defined offset.

3. The microphone module as claimed in claim 1, wherein the offset generator is configured to adapt the defined offset in such a way that limit cycles of the first modulator and of the second modulator differ by at least 5 kHz.

4. The microphone module as claimed in claim 1, wherein the defined offset is −60 dBFS or more.

5. The microphone module as claimed in claim 1, wherein the first modulator and the second modulator comprise 1-bit modulators.

6. The microphone module as claimed in claim 1, wherein outputs of the first modulator and of the second modulator are connected to a same data line.

7. The microphone module as claimed in claim 1, wherein the first MEMS microphone and the second MEMS microphone are clocked with a same clock signal.

8. The microphone module as claimed in claim 7, wherein the first modulator and the second modulator are clocked with different edges of the same clock signal.

9. The microphone module as claimed in claim 1, wherein the first modulator and the second modulator comprise digital modulators.

10. The microphone module as claimed in claim 1, wherein the first modulator and the second modulator comprise analog-to-digital converters, and wherein the defined offset comprises an analog DC value.

11. The microphone module as claimed in claim 1, wherein the first MEMS microphone and the second MEMS microphone are switchable in each case between a first operating state and a second operating state, wherein the first MEMS microphone and the second MEMS microphone are switched into different operating states, wherein the defined offset is applied to the input of the first modulator if the first MEMS microphone is switched into the first operating state, wherein the defined offset is applied to the input of the second modulator if the second MEMS microphone is switched into the first operating state, and wherein the first MEMS microphone and the second MEMS microphone are switched into the respective operating state by a control signal present at the respective MEMS microphone or by a control value present at the respective MEMS microphone.

12. The microphone module as claimed in claim 11, wherein the first MEMS microphone and the second MEMS microphone are allocated to different channels of a multi-channel application by the different operating states.

13. The microphone module as claimed in claim 1, wherein the offset generator comprises a first offset generator connected to the input of the first modulator, wherein the first offset generator is configured to apply a defined first offset to the input of the first modulator, and wherein the microphone module comprises a second offset generator connected to the input of the second modulator, wherein the second offset generator is configured to apply a defined second offset to the input of the second modulator.

14. The microphone module as claimed in claim 13, wherein the first MEMS microphone and the second MEMS microphone are switchable in each case between a first operating state and a second operating state, wherein the first offset generator is configured to apply the defined first offset to the input of the first modulator only if the first MEMS microphone is switched into the first operating state, wherein the second offset generator is configured to apply the defined second offset to the input of the second modulator only if the second MEMS microphone is switched into the first operating state, and wherein the first MEMS microphone and the second MEMS microphone are switched into different operating states.

15. The microphone module as claimed in claim 14, wherein the first MEMS microphone and the second MEMS microphone are switched into the respective operating state by a control signal present at the respective MEMS microphone or by a control value present at the respective MEMS microphone.

16. The microphone module as claimed in claim 13, wherein the first offset generator and the second offset generator are configured to apply different defined offsets to the respective inputs of the first modulator and of the second modulator.

17. The microphone module as claimed in claim 1, wherein the first MEMS microphone and the second MEMS microphone are switchable in each case between a first operating state and a second operating state, wherein the first MEMS microphone and the second MEMS microphone are switched into different operating states, wherein the offset generator comprises a first offset generator connected to the input of the first modulator, wherein the first offset generator is configured to apply a defined first offset to the input of the first modulator if the first MEMS microphone is switched into the first operating state, wherein the first offset generator is configured to apply a defined second offset to the input of the first modulator if the first MEMS microphone is switched into the second operating state, wherein the microphone module comprises a second offset generator connected to the input of the second modulator, wherein the second offset generator is configured to apply the defined first offset to the input of the second modulator if the second MEMS microphone is switched into the first operating state, wherein the second offset generator is configured to apply the defined second offset to the input of the second modulator if the second MEMS microphone is switched into the second operating state, wherein the defined first offset and the defined second offset are different, and wherein the first MEMS microphone and the second MEMS microphone are switched into the respective operating state by a control signal present at the respective MEMS microphone or by a control value present at the respective MEMS microphone.

18. The microphone module as claimed in claim 17, wherein the defined first offset and the defined second offset are different than zero.

19. The microphone module as claimed in claim 17, wherein the first MEMS microphone and the second MEMS microphone are allocated to different channels of a multi-channel application by the different operating states.

20. The microphone module as claimed in claim 1, wherein the first MEMS microphone comprises a first offset compensator connected to the input of the first modulator, wherein the first offset compensator is configured to reduce an analog offset generated by the microphone module or by the first MEMS microphone itself at the input of the first modulator, and wherein the second MEMS microphone comprises a second offset compensator connected to the input of the second modulator, wherein the second offset compensator is configured to reduce an analog offset generated by the microphone module or by the second MEMS microphone itself at the input of the second modulator.

21. A method for operating a microphone module comprising a first MEMS (Micro-Electro-Mechanical Systems) microphone and a second MEMS microphone, wherein the method comprises:

generating a defined offset by an offset generator of the microphone module, and applying the defined offset directly to an input of a modulator of the first MEMS microphone or of the second MEMS microphone in order to shift a response cycle of the modulator of the respective MEMS microphone with respect to a response cycle of a modulator of the other MEMS microphone.

22. A microphone module, comprising:

a first MEMS (Micro-Electro-Mechanical Systems) microphone, wherein the first MEMS microphone comprises a first modulator; and a second MEMS microphone, wherein the second MEMS microphone comprises a second modulator, wherein the first modulator is clocked with a first clock frequency, and wherein the second modulator is clocked with a second clock frequency, wherein the first clock frequency and the second clock frequency are different.

23. The microphone module as claimed in claim 22, wherein one clock frequency of the two clock frequencies is reduced relative to the other clock frequency.

24. The microphone module as claimed in claim 23, wherein one clock frequency of the two clock frequencies is reduced relative to the other clock frequency in such a way that limit cycles of the first modulator and of the second modulator differ by at least the factor 1.5.

25. The microphone module as claimed in claim 22, wherein the first MEMS microphone comprises a first sampling rate converter connected downstream of the first modulator, or wherein the second MEMS microphone comprises a second sampling rate converter connected downstream of the second modulator.

26. The microphone module as claimed in claim 25, wherein the first MEMS microphone is configured to connect the first sampling rate converter downstream of the first modulator only in the first operating state, and wherein the second MEMS microphone is configured to connect the second sampling rate converter downstream of the second modulator only in the first operating state.

27. The microphone module as claimed in claim 26, wherein the first MEMS microphone is configured to connect the first sampling rate converter upstream of the first modulator in the second operating state, and wherein the second MEMS microphone is configured to connect the second sampling rate converter upstream of the second modulator in the second operating state.

28. The microphone module as claimed in claim 22, wherein the first MEMS microphone and the second MEMS microphone are switchable in each case between a first operating state and a second operating state, wherein the first clock frequency, with which the first modulator is clocked, is reduced relative to the second clock frequency if the first MEMS microphone is switched into the first operating state, wherein the second clock frequency, with which the second modulator is clocked, is reduced relative to the first clock frequency if the second MEMS microphone is switched into the first operating state, and wherein the first MEMS microphone and the second MEMS microphone are switched into different operating states.

29. The microphone module as claimed in claim 22, wherein the first modulator and the second modulator comprise 1-bit modulators.

30. The microphone module as claimed in claim 22, wherein the first MEMS microphone and the second MEMS microphone provide output values with the same sampling rate.

31. The microphone module as claimed in claim 30, wherein the first MEMS microphone and the second MEMS microphone provide the respective output values in response to different edges of a clock signal having the first clock frequency or the second clock frequency.

32. The microphone module as claimed in claim 30, wherein the first MEMS microphone comprises a first analog-to-digital converter, wherein the first analog-to-digital converter is clocked with the first clock frequency, and wherein the second MEMS microphone comprises a second analog-to-digital converter, wherein the second analog-to-digital converter is clocked with the first clock frequency.

33. The microphone module as claimed in claim 30, wherein the first MEMS microphone comprises a first analog-to-digital converter, wherein the first analog-to-digital converter is clocked with the second clock frequency, wherein the first MEMS microphone comprises a third sampling rate converter connected downstream of the first analog-to-digital converter, wherein the second MEMS microphone comprises a second analog-to-digital converter, wherein the second analog-to-digital converter is clocked with the second clock frequency, and wherein the second MEMS microphone comprises a fourth sampling rate converter connected downstream of the second analog-to-digital converter.

34. The microphone module as claimed in claim 22, wherein outputs of the first MEMS microphone and of the second MEMS microphone are connected to a same data line.

35. The microphone module as claimed in claim 22, wherein the first modulator and the second modulator comprise digital modulators.

36. The microphone module as claimed in claim 35, wherein the first MEMS microphone comprises a first digital filter, wherein the first digital filter is connected upstream of the first modulator or the first sampling rate converter, and wherein the first digital filter is clocked with the first clock frequency, and wherein the second MEMS microphone comprises a second digital filter, wherein the second digital filter is connected upstream of the second sampling rate converter or the second modulator, and wherein the second digital filter is clocked with the first clock frequency.

37. The microphone module as claimed in claim 22, wherein the first modulator and the second modulator are analog-to-digital converters, and wherein the first MEMS microphone comprises a sampling rate converter connected downstream of the first modulator.

38. A method for operating a microphone module comprising a first MEMS (Micro-Electro-Mechanical Systems) microphone and a second MEMS microphone, wherein the method comprises:

clocking a first modulator of the first MEMS microphone having a first clock frequency; and clocking a second modulator of the second MEMS microphone with a second clock frequency, wherein the first clock frequency and the second clock frequency are different.

* * * * *